United States Patent [19]

Moyroud

[11] 4,230,399

[45] Oct. 28, 1980

[54] PHOTOCOMPOSING MACHINE AND METHOD

[76] Inventor: Louis M. Moyroud, 202 Grove Way, Delray Beach, Fla. 33444

[21] Appl. No.: 899,001

[22] Filed: Apr. 21, 1978

[30] Foreign Application Priority Data

Apr. 26, 1977 [GB] United Kingdom ..... 17431/77

[51] Int. Cl.[3] ..... B41B 15/08; B41B 15/16; B41B 17/04; B41B 17/18

[52] U.S. Cl. ..... 354/10; 354/11; 354/13; 354/14; 354/19

[58] Field of Search ..... 354/5, 10, 11, 18, 19, 354/13, 14

[56] References Cited

U.S. PATENT DOCUMENTS

| | | | |
|---|---|---|---|
| 2,715,862 | 8/1955 | Moyroud et al. | 354/15 |
| 3,228,313 | 1/1966 | Higonnet et al. | 354/14 |
| 3,249,028 | 5/1966 | Higonnet et al. | 354/8 |
| 3,738,236 | 6/1973 | Grube et al. | 354/15 |
| 4,040,066 | 8/1977 | Brill et al. | 354/10 |

FOREIGN PATENT DOCUMENTS

| | | |
|---|---|---|
| 2243354 | 4/1974 | Fed. Rep. of Germany . |
| 1050921 | 12/1966 | United Kingdom . |

*Primary Examiner*—Michael L. Gellner
*Attorney, Agent, or Firm*—Curtis, Morris & Safford

[57] ABSTRACT

The machine preferably has a character matrix comprising a rotating drum with character-bearing film strips wrapped around it. The machine has a light source comprising a plurality of flash lamps and fiber-optic light pipes. The light-pipes are arranged in a linear array aligned parallel to the direction of travel of the film strips on the drum. Photographic film is formed into a semi-cylindrical arc and remains stationary during composition of up to a full newspaper page of text before the film is moved to another exposure position. Both character spacing and line spacing are performed by a combination of selective timing of the operation of the flash lamps, a lens and reflector traveling parallel to the film in a beam of collimated light, and a swinging mirror mounted on the axis of the semi-cylinder formed by the film. Both timing slits and base-line reference marks are located on the film strips near each character. The base-line reference marks are detected and used to make automatic corrections of the character image locations to ensure excellent base-alignment of the characters on the film. Other corrections of the character image locations are stored in a memory and are made automatically during composition. Several steps are taken to ensure accurate character spacing. A separate, independent timing circuit is used to time the flashing of each character. Also, the timing is determined by reference only to the timing slit immediately next to the character to be flashed. Furthermore, timing delay is controlled by a clock pulse source whose frequency is controlled by the drum rotation so as to compensate for instantaneous variations in drum speed and/or position. Each film strip bears coded indicia indicating the illumination level required for each different type face on the strip. Automatic adjustments are made to compensate for the divergence of the collimated light towards the end of very long lines of type composition. Special means are provided to compensate for the extension of italics and slanted characters to one side or the other of the normal character area. Means also are provided for the insertion of "pi" characters and forming rules.

34 Claims, 73 Drawing Figures

FIG.9

| character | max WIDTH | rank value | drum sequence | character | max WIDTH | rank value | drum sequence | character | max WIDTH | rank value | drum sequence | character | max WIDTH | rank value | drum sequence |
|---|---|---|---|---|---|---|---|---|---|---|---|---|---|---|---|
| e | 22 | 62 | 1 | v | 22 | 2410 | 37 | k | 25 | 4742 | 73 | $ | 22 | 7066 | 109 |
| E | 30 | 132 | 2 | V | 30 | 2480 | 38 | K | 34 | 4816 | 74 | : | 13 | 7119 | 110 |
| 1 | 22 | 194 | 3 | 5/8 | 36 | 2556 | 39 | 0zéro | 32 | 4888 | 75 | . | 13 | 7172 | 111 |
| ~f | 15 | 249 | 4 | ( | 15 | 2611 | 40 | a x | 22 | 4950 | 76 | quot | 13 | 7225 | 112 |
| z | 20 | 309 | 5 | s | 18 | 2669 | 41 | h | 25 | 5015 | 77 | + | 36 | 7301 | 113 |
| Z | 30 | 379 | 6 | S | 25 | 2734 | 42 | H | 37 | 5092 | 78 | - dash | 22 | 7363 | 114 |
| 1/8 | 36 | 455 | 7 | 6 | 22 | 2796 | 43 | g | 22 | 5154 | 79 | % | 36 | 7439 | 115 |
| •• | 15 | 510 | 8 | ) | 15 | 2851 | 44 | G | 37 | 5231 | 80 | & | 36 | 7515 | 116 |
| t | 15 | 565 | 9 | u | 25 | 2916 | 45 | f | 15 | 5286 | 81 | ⅛ | 13 | 7568 | 117 |
| T | 30 | 635 | 10 | U | 34 | 2990 | 46 | F | 30 | 5356 | 82 | J(1) | 13 | 7621 | 118 |
| 2 | 22 | 697 | 11 | 3/4 | 36 | 3066 | 47 | d | 25 | 5421 | 83 | F | 16 | 7677 | 119 |
| ⌄f | 15 | 752 | 12 | [ | 15 | 3121 | 48 | D | 37 | 5469 | 84 | F | 16 | 7733 | 120 |
| y | 22 | 814 | 13 | o | 25 | 3186 | 49 | c | 22 | 5560 | 85 | F | 16 | 7789 | 121 |
| Y | 32 | 886 | 14 | O | 34 | 3260 | 50 | C | 32 | 5632 | 86 | F | 16 | 7845 | 122 |
| 1/4 | 36 | 962 | 15 | 7 | 22 | 3322 | 51 | b | 25 | 5697 | 87 | F | 16 | 7901 | 123 |
| f/8 | 15 | 1015 | 16 | e x | 22 | 3384 | 52 | B | 32 | 5769 | 88 | F | 16 | 7957 | 124 |
| a | 22 | 1077 | 17 | q | 25 | 3449 | 53 | h x | 25 | 5834 | 89 | ® | 36 | 8033 | 125 |
| A | 34 | 1151 | 18 | Q | 34 | 3523 | 54 | i x | 13 | 5887 | 90 | •• | 26 | 8099 | 126 |
| 3 | 22 | 1213 | 19 | 7/8 | 36 | 3599 | 55 | r x | 18 | 5945 | 91 | – | 39 | 8178 | 127 |
| 5f | 15 | 1268 | 20 | ! | 17 | 3656 | 56 | o x | 25 | 6010 | 92 | O | 36 | 8254 | 128 |
| x | 22 | 1330 | 21 | r | 18 | 3714 | 57 | p x | 25 | 6075 | 93 | © | 36 | 8330 | 129 |
| X | 34 | 1404 | 22 | R | 34 | 3788 | 58 | g x | 22 | 6137 | 94 | Su | 16 | 8386 | 130 |
| 3/8 | 36 | 1480 | 23 | 8 | 22 | 3850 | 59 | f x | 15 | 6192 | 95 | Su | 16 | 8442 | 131 |
| = | 36 | 1556 | 24 | ? | 20 | 3910 | 60 | d x | 25 | 6257 | 96 | Su | 16 | 8498 | 132 |
| i | 13 | 1609 | 25 | p | 25 | 3975 | 61 | l x | 13 | 6310 | 97 | Su | 16 | 8554 | 133 |
| I | 18 | 1667 | 26 | P | 28 | 4043 | 62 | c x | 22 | 6372 | 98 | Su | 16 | 8610 | 134 |
| 4 | 22 | 1729 | 27 | t x | 15 | 4098 | 63 | m x | 37 | 6449 | 99 | Su | 16 | 8666 | 135 |
| Xm | 36 | 1805 | 28 | n x | 25 | 4163 | 64 | S x | 18 | 6507 | 100 | Su | 16 | 8722 | 136 |
| w | 32 | 1877 | 29 | m | 37 | 4240 | 65 | b x | 25 | 6572 | 101 | Su | 16 | 8778 | 137 |
| W | 44 | 1961 | 30 | M | 44 | 4324 | 66 | – min | 36 | 6648 | 102 | Su | 16 | 8834 | 138 |
| 1/2 | 36 | 2037 | 31 | 9 | 22 | 4386 | 67 | - hyp | 15 | 6703 | 103 | Su | 16 | 8890 | 139 |
| ^f | 15 | 2092 | 32 | ] | 15 | 4441 | 68 | • per | 13 | 6756 | 104 | Sp | 36 | 8966 | 140 |
| n | 25 | 2157 | 33 | L | 13 | 4494 | 69 | , com | 13 | 6809 | 105 | Sp | 36 | 9042 | 141 |
| N | 34 | 2231 | 34 | L | 30 | 4564 | 70 | y x | 22 | 6871 | 106 | Sp | 36 | 9118 | 142 |
| 5 | 22 | 2293 | 35 | j | 13 | 4617 | 71 | ⌄ing | 13 | 6924 | 107 | Sp | 36 | 9194 | 143 |
| 1f | 15 | 2348 | 36 | J | 20 | 4677 | 72 | ... | 40 | 7004 | 108 | Sp | 36 | 9270 | 144 |

x repeated char.(18)

for drum speed: 20rps: 2,6 μ sec/unit
500 μsec is 192 units = 3 char.

total capacity 300mm $$\text{DIA}: \frac{942.477 \,.\, 2}{0{,}01953 \,.\, 2.5} = 9.651$$

spare: 9.651 - 9.270 = 381 unit.

FIG.10

| CHARACTERS COMPOSED | DRUM SEQUENCE | FLASH SEQUENCE | CHARACTER WIDTH | "PRECEDING" ACCUM. WIDTH | LIGHT PIPES ACTIVATED 1 | 2 | 3 | 4 | 5 | 6 |
|---|---|---|---|---|---|---|---|---|---|---|
| O | 50 | 7 | 28 | 0 | x | | | | | |
| n | 33 | 5 | 20 | 28 | x | x | | | | |
| c | 85 | 10 | 18 | 48 | | x | | | | |
| e | 1 | 1 | 18 | 66 | | x | x | | | |
| sp | – | – | 18 | 84 | | | | | | |
| t | 9 | 3 | 12 | 102 | | | x | | | |
| h | 77 | 9 | 20 | 114 | | | x | x | | |
| e | 1 | 2 | 18 | 134 | | | | x | | |
| sp | – | – | 18 | 152 | | | | | | |
| i | 25 | 4 | 10 | 170 | | | | | x | |
| n | 33 | 6 | 20 | 180 | | | | | x | x |
| n* | 64 | 8 | 20 | 200 | | | | | | x |
| o | 49 | | 20 | 20 | x | x | | | | |
| v | 37 | | 18 | 40 | | x | | | | |
| a | 17 | | 18 | 58 | | x | | | | |
| t | 9 | | 12 | 76 | | x | x | | | |
| o | 49 | | 20 | 88 | | | x | | | |
| r | 57 | | 14 | 108 | | x | x | | | |
| sp | – | – | 18 | 122 | | | | | | |
| d | 83 | | 20 | 140 | | | | x | | |
| e | 1 | | 18 | 160 | | | | | x | |
| m | 65 | | 30 | 178 | | | | | x | |
| o | 49 | | 20 | 8 | x | | | | | |
| n | 33 | | 20 | 28 | x | | | | | |
| s | 41 | | 14 | 48 | | x | | | | |
| t | 9 | | 12 | 62 | | x | | | | |
| r | 57 | | 14 | 74 | | x | x | | | |
| a | 17 | | 18 | 88 | | | x | | | |
| t | 9 | | 12 | 106 | | | x | | | |
| e | 1 | | 18 | 118 | | x | x | | | |
| s | 41 | | 14 | 136 | | | x | | | |
| sp | – | – | 18 | 150 | | | | | | |
| d | 83 | | 20 | 168 | | | | | x | |
| u | 45 | | 20 | 188 | | | | | x | x |
| r | 57 | | 14 | 8 | x | | | | | |
| l | 25 | | 10 | | | | | | | |

FIG.11

| CHARACTERS COMPOSED | D2 | D3 | Sf | AW | LIGHT PIPES ACTIVATED 1 | 2 | 3 | 4 | 5 | 6 |
|---|---|---|---|---|---|---|---|---|---|---|
| O | 0 | 2500 | 86 | 0 | | | x | | | |
| n | 840 | 810 | 28 | 28 | x | x | | | | |
| c | 1440 | 2810 | 97 | 48 | | | x | | | |
| e | 1980 | 4070 | 140 | 66 | | | | x | x | |
| sp | | | | 84 | | | | | | |
| t | 3060 | 3390 | 117 | 102 | | | x | x | | |
| h | 3420 | 430 | 15 | 114 | x | | | | | |
| e | 4020 | 2030 | 70 | 134 | | x | x | | | |
| sp | | | | 152 | | | | | | |
| i | 5100 | 2150 | 74 | 170 | | x | x | | | |
| n | 5400 | 2250 | 77 | 180 | | x | x | | | |
| n | 6000 | 3200 | 110 | 200 | | | x | x | | |
| o | $^{1+}$600 | 1850 | 64 | 220 | | x | x | | | |
| v | $^{1+}$1200 | 650 | 22 | 240 | x | x | | | | |
| a | $^{1+}$1740 | 5110 | 176 | 258 | | | | | x | |
| t | $^{1+}$2280 | 4170 | 144 | 276 | | | | x | | |
| o | $^{1+}$2640 | 5810 | 200 | 288 | | | | | | x |
| r | $^{1+}$3240 | 5610 | 193 | 308 | | | | | x | x |
| sp | | | | 322 | | | | | | |
| d | $^{1+}$4200 | 5950 | 205 | 340 | | | | | | x |
| e | $^{1+}$4800 | 1250 | 43 | 360 | | x | | | | |
| m | $^{1+}$5340 | 3910 | 135 | 378 | | | | x | x | |
| o | $^{2+}$240 | 2210 | 76 | 408 | | x | x | | | |
| n | $^{2+}$840 | 810 | 28 | 428 | x | x | | | | |
| s | $^{2+}$1440 | 610 | 21 | 448 | x | | | | | |
| t | $^{2+}$1860 | 4590 | 158 | 462 | | | | x | x | |
| r | $^{2+}$2220 | 630 | 22 | 474 | x | | | | | |
| a | $^{2+}$2640 | 4210 | 145 | 488 | | | | x | x | |
| t | $^{2+}$3180 | 3270 | 113 | 506 | | | x | x | | |
| e | $^{2+}$3540 | 2510 | 86 | 518 | | | x | | | |
| s | $^{2+}$4080 | 3970 | 137 | 536 | | | | x | | |
| sp | | | | 550 | | | | | | |

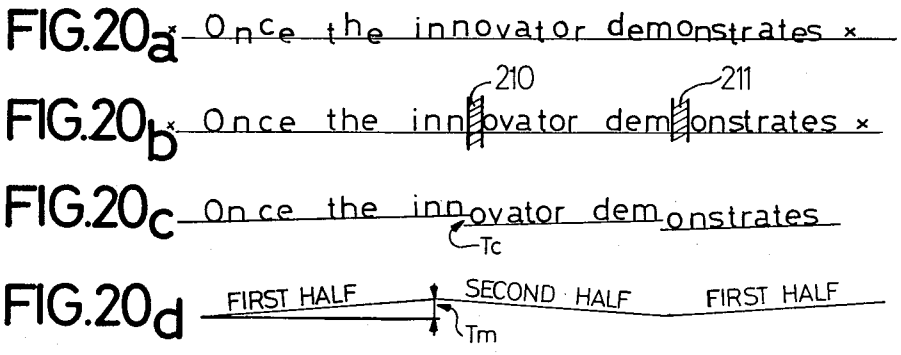
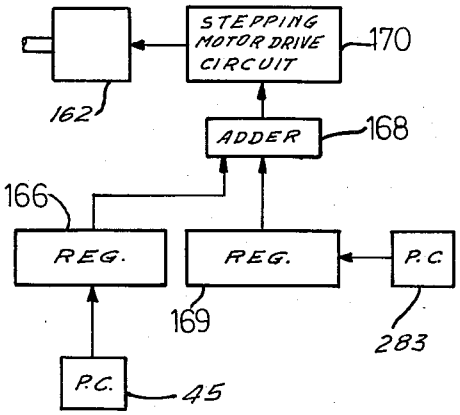
FIG.21

62-1
62-2
62-3
62-4
62-5
62-6
0 39
40 79
80 119
120 159
160 199
200

134
66

112
28
108n-1
n et e in 113
108n-2
On et e inn

Once the inn

Once the innovator dem

Once the innovator demonstrates du
124
103
95

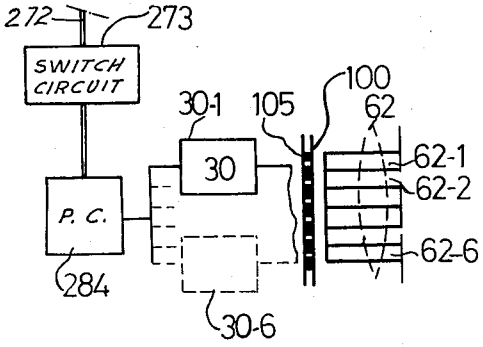
FIG.36
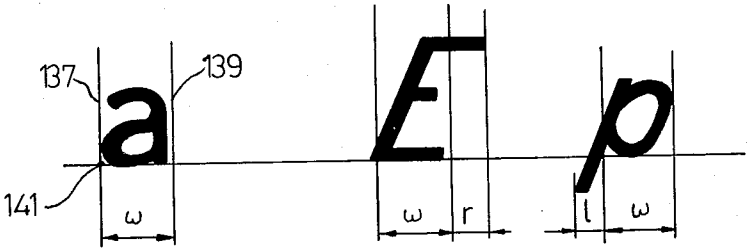
FIG.37
FIG.38
FIG.39

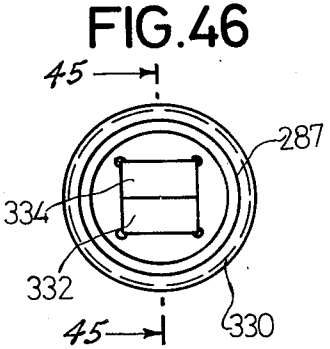
FIG. 46
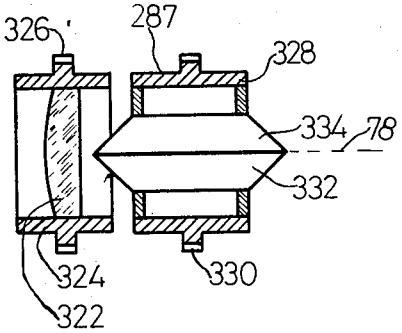
FIG. 45
FIG. 44
once once once once
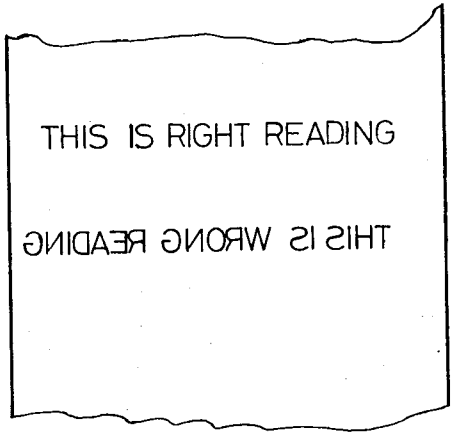
FIG. 43

PHOTOCOMPOSING MACHINE AND METHOD

TABLE OF CONTENTS

I. FIELD OF THE INVENTION
II. OBJECTS OF AND PROBLEMS SOLVED BY THE INVENTION
III. DESCRIPTION OF THE DRAWINGS
IV. GENERAL DESCRIPTION
V. ROW OR LEVEL SELECTION
VI. AUXILIARY (PI CHARACTER) INPUT-GENERAL DESCRIPTION
VII. USE OF SWINGING MIRROR FOR CHARACTER SPACING-GENERAL DESCRIPTION
VIII. COLLIMATED BEAM DIVERGENCE CORRECTION GENERAL DESCRIPTION
IX. FILM STRIP
A. Base-Line Reference Marks
B. Illumination Level Code Marks
C. Timing Slits
D. Film-Strip Mounting
X. STRUCTURE OF PROJECTION ZONE AND EXACT TIMING
A. Character Sequence Selection
B. Selection and Operation of Light Channels-General Description
C. Example
D. Light Channel Section Detailed Description
E. Italics Correction
XI. CHARACTER SPACING WITH CONTINUOUS MOTION
A. Control Circuit-Continuous Mode
B. Light Pipe Selection-Continuous Mode
C. Example-Continuous Mode
D. Composition Forward and Backwards Continuous Mode
XII. FILM HOLDER, PAGE AND LINE SPACING
XIII. USE OF SWING MIRROR FOR CHARACTER SPACING-DETAILED DESCRIPTION
XIV. BASE LINE CORRECTION
A. Correction Blade
B. Correction Blade Control
XV. OTHER CORRECTIONS
A. Magnification Errors
1. Magnification Correction
2. Spacing Correction
3. Adjustable Lens Correction
B. "Ladder" Defects
C. Base-Line Mis-Alignment In Abutting Film Strips
D. Base-Line Errors Due to Lens Changes
E. Spacing Carriage Location Errors
XVI. FOCUS CONTROL
XVII. LIGHT CONTROL
XVIII. OPTICAL OUTPUT IMAGE CHANGES
A. Shifting Between Right-And Wrong-Reading Output Copy
B. Collimated Beam Divergence Correction-Detailed Description
C. Rotation of Characters
D. Squeezing and Expanding Characters
XIX. AUXILIARY (PI CHARACTER) INPUT-DETAILED DESCRIPTION
XX. PAGE COMPOSITION
XXI. MANUFACTURE OF FILM STRIPS

I. FIELD OF THE INVENTION

The present invention relates to photographic composing machines and methods, and more particularly to means and methods for selecting, projecting and positioning at high speed and with a high degree of accuracy all of the characters of a page without moving the photo-sensitive surface on which the characters are composed.

II. OBJECTS OF AND PROBLEMS SOLVED BY THE INVENTION

Prior photocomposing equipment consists primarily of "second generation" equipment and "third generation" equipment. "Second generation" equipment forms character images by projecting light through a photographic master or matrix, whereas "third generation" equipment builds character images by assembling thin lines or "strokes" into characters by means of a cathode ray tube or laser beam generator. In general, third generation machines are faster than second generation machines, but second generation machines are considerable less expensive and produce type composition of considerably higher quality; that is, in second generation equipment, character images are formed with much higher resolution and sharpness than in third generation equipment.

An object of the present invention is to provide photocomposing equipment and methods having the relatively low costs and producing the relatively high quality composition of second generation equipment and methods, while operating at speeds comparable to those of third generation equipment.

In certain prior "second generation" equipment, relatively high speeds have been obtained, but at the expense of other desirable parameters. For example, the maximum line length was reduced or the spcing and/or base alignment of characters was not maintained with the highest degree of accuracy.

It is another object of the invention to provide relatively high-speed composition without substantial deleterious effects on such other desirable parameters.

This object is met, in accordance with the invention, by the provision of a photocomposing machine using a rotating character matrix and a plurality of flash lamp means spaced from one another in a projection zone extending in the same direction as a line of characters on the matrix. Character spacing is accomplished by a combination of flash timing and mechanical motion of a character spacing mechanism. The use of flash timing greatly increases the speed of operation, while the use of mechanical motion maintains the maximum length of line at a relatively high level. The character spacing motion can be either continuous or intermittent. It it is intermittent, the spacing mechanism does not move to space each and every character, but instead moves only between successive locations at which blocks of characters are composed, with the spacing within each block being accomplished by means of flash timing.

Character spacing accuracy is ensured by the use of a flash timing mark located closely adjacent to each character to time the flashing of the character. This accuracy is enhanced by independently timing the flashing of each character, as opposed to the prior practice of making the timing of some characters dependent on the timing of others.

Character spacing accuracy is further enhanced by the use of the rotating character matrix to control the frequency of the master clock source used to control the flash timing so that variations in the matrix speed will not have deleterious effects on the flash timing.

In prior photocomposing machines, one of the impediments to achieving high speeds has been in the line spacing mechanism. In the present invention, this impediment is greatly alleviated by holding the film stationary and spacing lines of characters from one another by the use of a relatively light-weight, movable reflector.

Preferably, the film is curved into semi-cylindrical form so that a rotary reflector can be used to place characters on the film over a relatively large area, either for line spacing or character spacing. The film preferably is moved only after relatively large blocks of text have been composed. Thus, the movement of the film is minimized, and the composing speed has been enhanced.

Preferably, the character matrix is a film strip wrapped around a drum. The vertical axis of each character is perpendicular to the direction of movement past a projection point. In addition to a flash timing mark, a "base-line" reference mark is positioned with great accuracy relative to the character by simultaneous projection of master characters, timing and base-line marks during manufacture of the film strips. The base-line mark is utilized to generate an error signal to indicate the deviation of the character from a desired location. The error signal is used to develop an optical correction of the character image location to ensure highly accurate base alignment of the projection characters regardless of small mechanical inaccuracies or variations in the location or shape of the matrix drum or film strip. Preferably, location error is measured by electronic means from a base line mark slightly ahead of the projection point of the associated character in order to leave a sufficient time interval for an automatic base line correction mechanism to make the correction.

In one embodiment of the invention, the base line location error for each character can be stored and called up from storage when needed. The stored signal can be used to inhibit the flashing of characters until the correction mechanism has had time to complete its operation. The latter feature is especially valuable in cases in which film strip segments are joined end-to-end around the drum, thus causing sudden changes of a relatively large magnitude in the base-line locations of the characters.

Good base alignment of the characters is further enhanced by the provision of means for automatic base-line corrections necessitated by a change of magnification obtained either through changing lenses by means of a lens turret or the like, or by the use of a "Zoom" or variable focal-length lens.

The variations in requirements for the amount of illumination provided by the flash lamps also causes problems. The amount of illumination required depends on the "weight" of the type face. For example, bold or heavy type faces require less illumination than light or skinny type faces. In the past, information to automatically control the level of illumination in accordance with the weight of the type face has been stored in the memory of the controller of the photocomposing machine. In accordance with the present invention, the character matrix is provided with coded marks to indicate the weights of the type faces on the matrix. This helps to avoid errors, in that the proper code always will be used with the selected type style. It also reduces the usage of valuable memory space in the controller.

Other features of the invention include automatic means to correct (or alternatively to compensate for) errors or inaccuracies which can appear at different levels of magnification and cause a gap or an overlap between groups of characters spaced by flash timing within a group but spaced by mechanical displacement from group to group.

Another feature of the invention includes automatic or semi-automatic adjustment of the optical projection system for the best resolution on the film.

According to another feature of the invention, master characters of different styles are located in rows on a plurality of of character strips. The strips are mounted removably in grooves on the periphery of a continuously rotating drum. The selection of one row of characters (for style selection purposes, e.g.) can be obtained without moving the drum axially. Instead, the selection is made by simultaneously moving at different speeds, a relatively light-weight light deflection carriage and a similarly light-weight illumination carriage carrying a number of fiber optic bundles or light pipes.

According to another embodiment of the invention, the images of characters are projected to a curved photographic film area. The film area can be as long and as wide as a full newspaper page. A rotatable mirror is located at the center of curvature of the film and is mounted on a line-spacing carriage. The mirror is rotated by steps or continuously for character spacing. The characters are formed into lines which extend circumferentially with respect to the semi-cylinder formed by the film. The line-spacing carriage moves along the axis of the cylinder to space lines of characters from one another.

According to another feature of the invention, the optical path along which characters are projected includes a collimated zone in which an anamorphic optical system is positioned in order to "squeeze" or "expand" characters, or make small magnification changes. There is also a provision for inserting in the collimated zone different prisms to produce right- or wrong- reading copy or turn characters around for various purposes.

According to another feature of the invention, the maximum length of line for relatively large magnifications is increased by the automatic insertion of a de-and-re-collimating system for the purpose of bringing back closer to the optical axis the divergent light beams emerging from the collimating lens or lenses of the optical system in composing relatively long lines.

According to another feature of the invention, the illuminated area of each character can be adjusted so that, for example for italics, the actual illuminated area of the matrix strip is wider than the nominal width of the character to be projected.

According to another feature of the invention, the style-selecting carriage can be moved beyond the optical axis of the projection system to provide for an auxiliary entry for Pi-characters or the continuous projection of light to produce vertical or horizontal rules.

The foregoing and other objects and advantages of the invention will be set forth in or apparent from the following description and drawings.

III. DESCRIPTION OF THE DRAWINGS

FIGS. 9 to 11 are tables used to illustrate the operation of the photocomposing machine of the invention;

Figure 1:
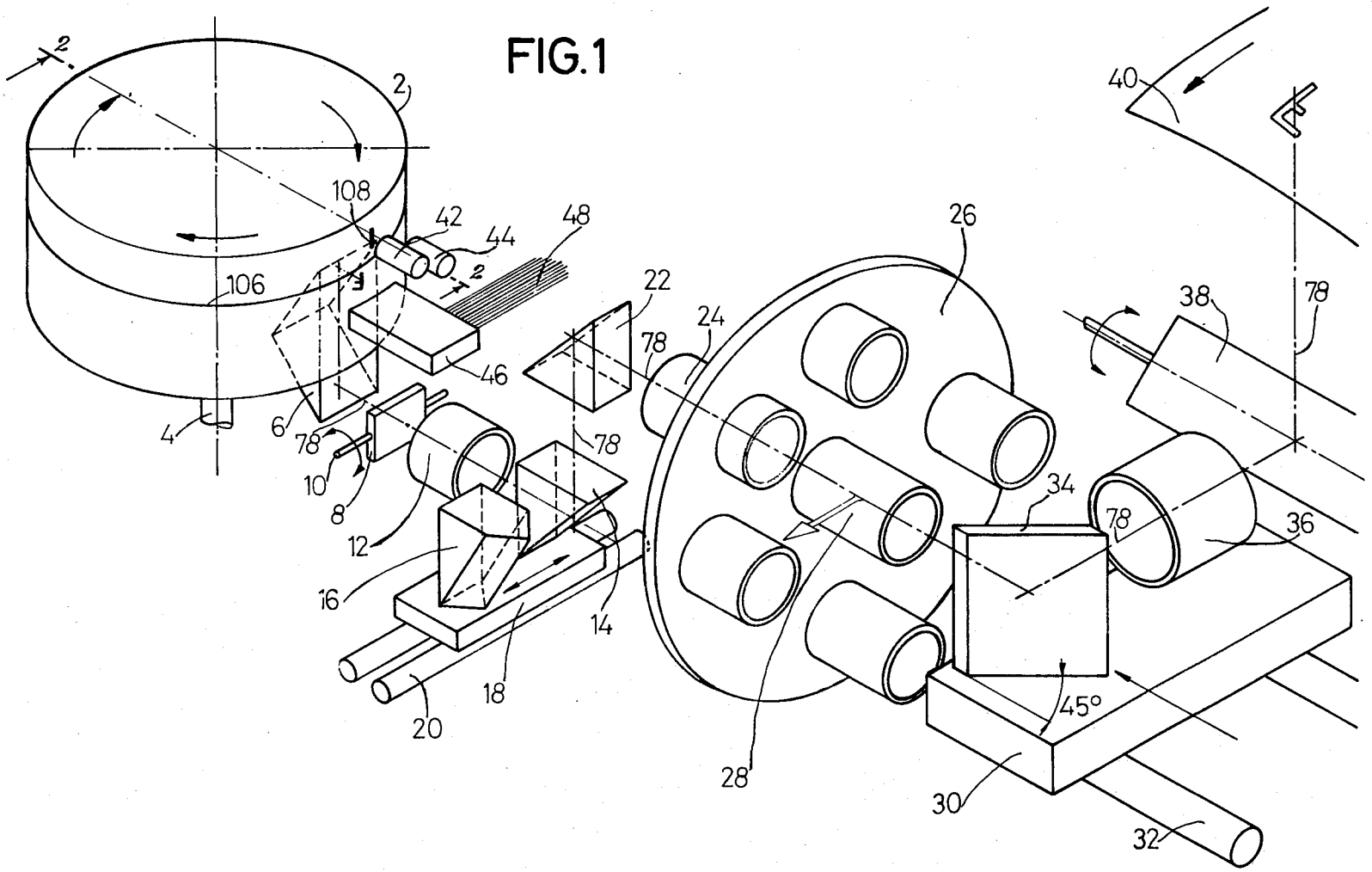
FIG. 1 is a schematic perspective view of the major optical and mechanical components of a photocomposing machine constructed in accordance with the invention.
Figure 14:
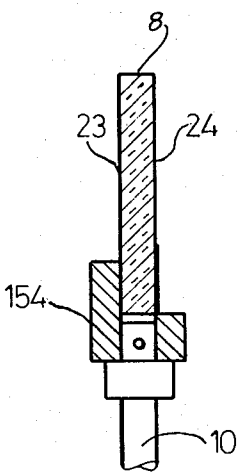
FIG. 14 is a cross-sectional view taken along line 14—14 of FIG. 13.
Figure 15:
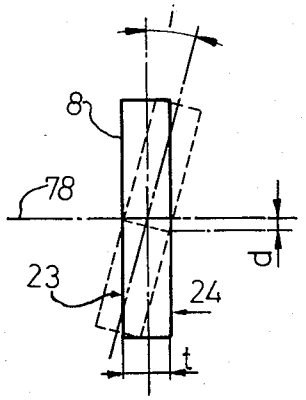
FIG. 15 is a schematic view of the optical flat of the device shown in FIGS. 13 and 14.
Figure 13:
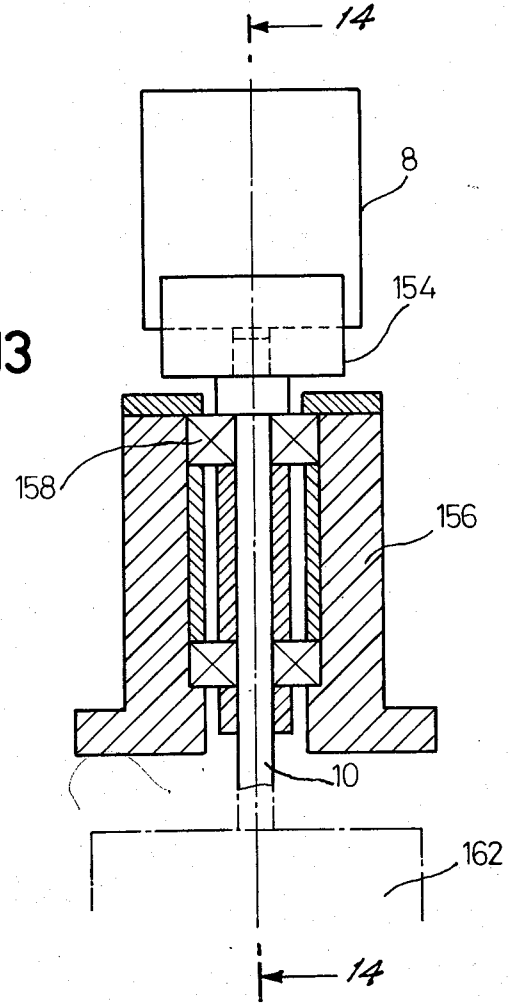
FIG. 13 is a partially cross-sectional elevation view of the mounting and drive system for base-line correction in the machine of FIG. 1.
Figure 16:
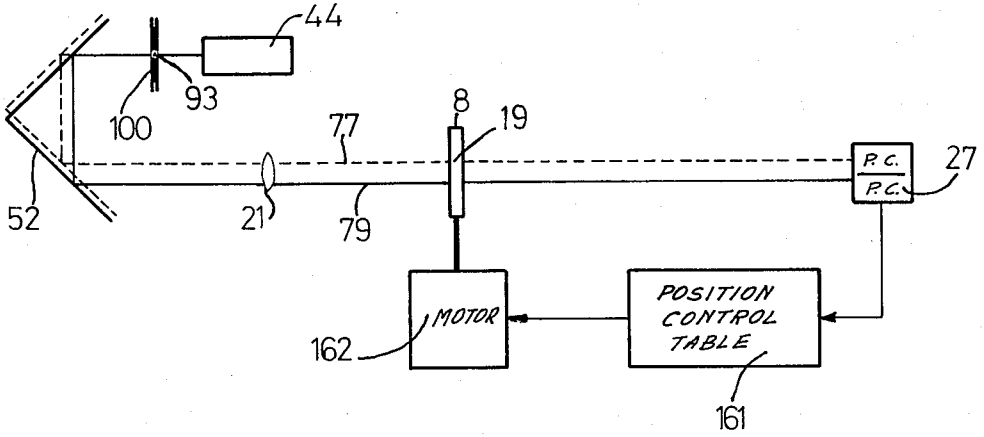
Figure 18:
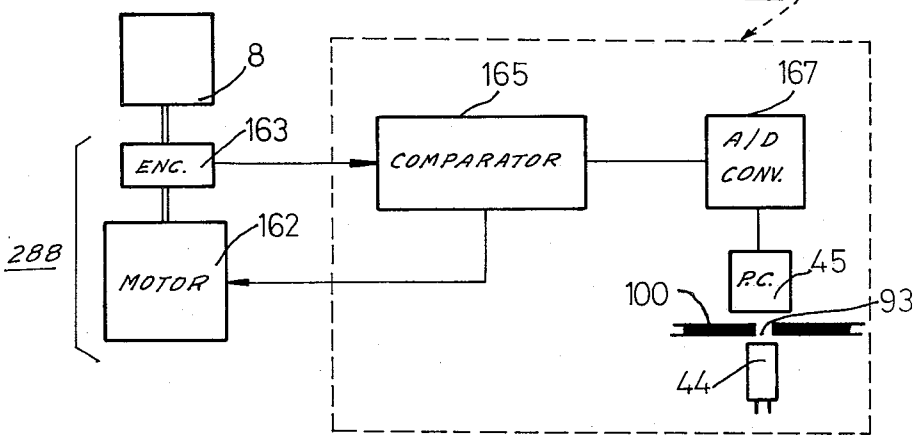
Figure 17:
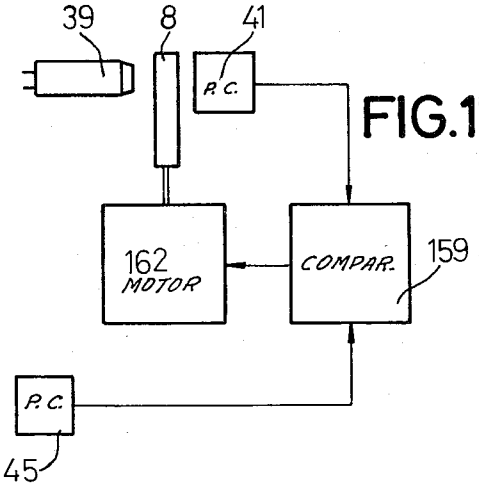
Figure 19:
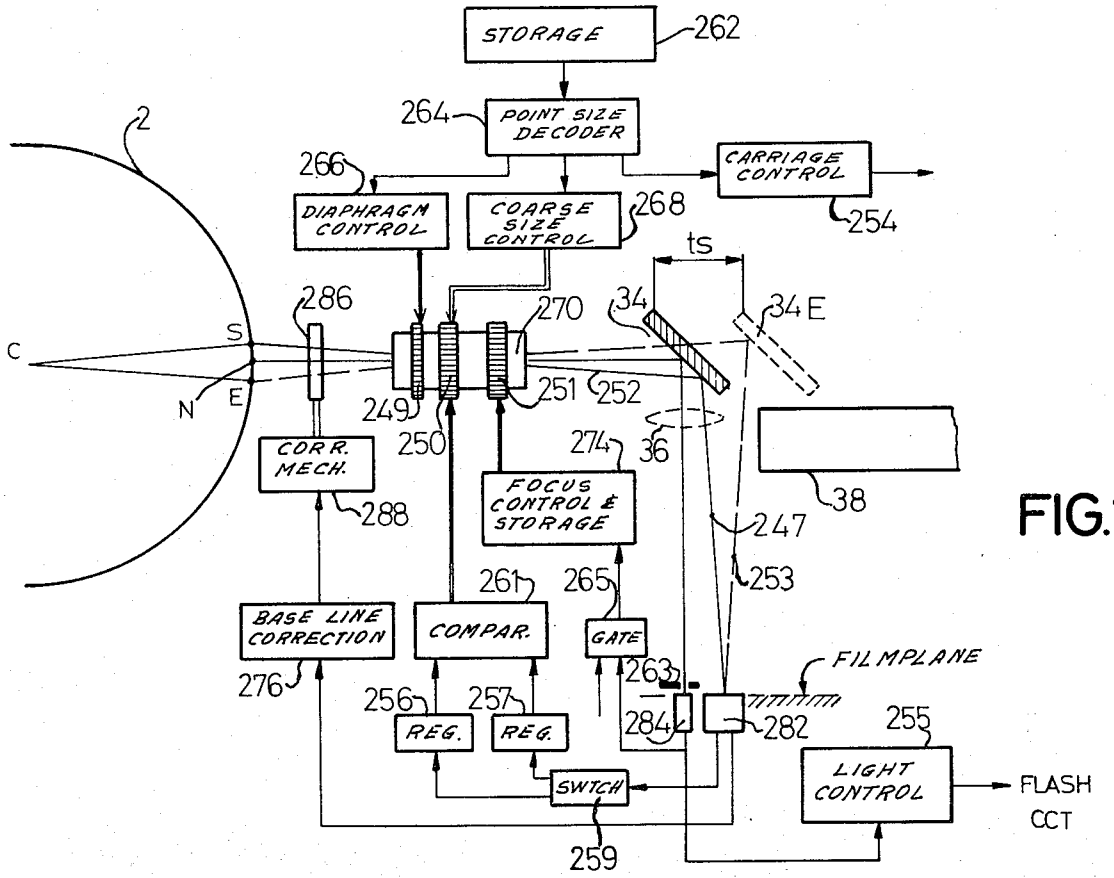
Figure 24:
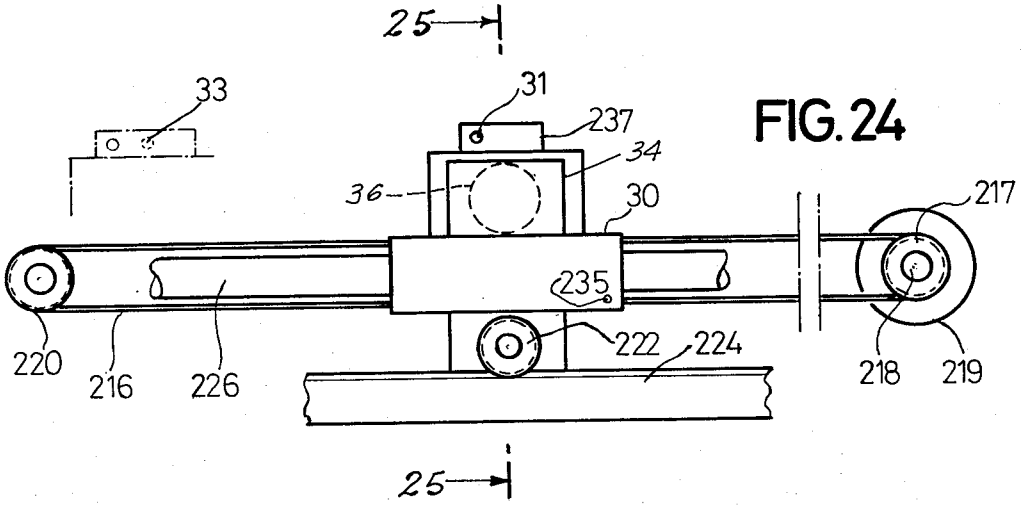
Figure 26:
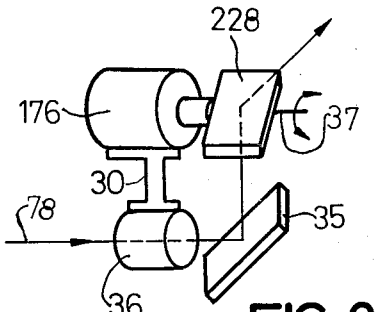
Figure 25:
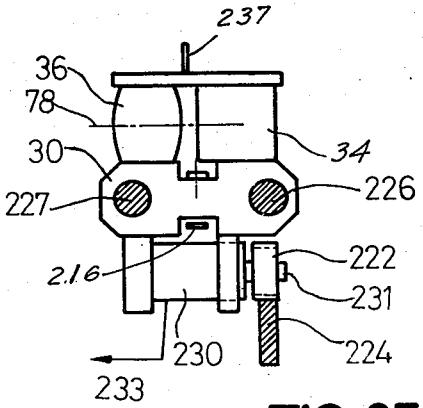
Figure 27:
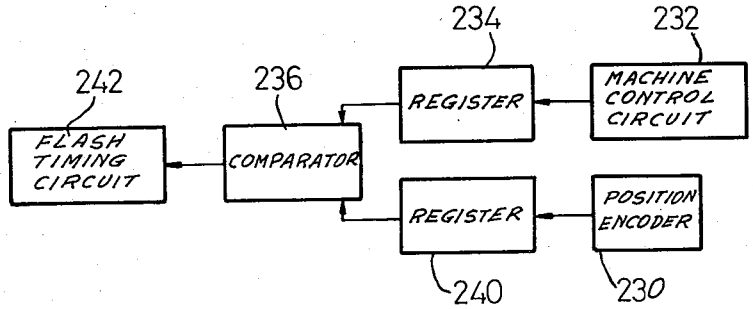
Figure 28:
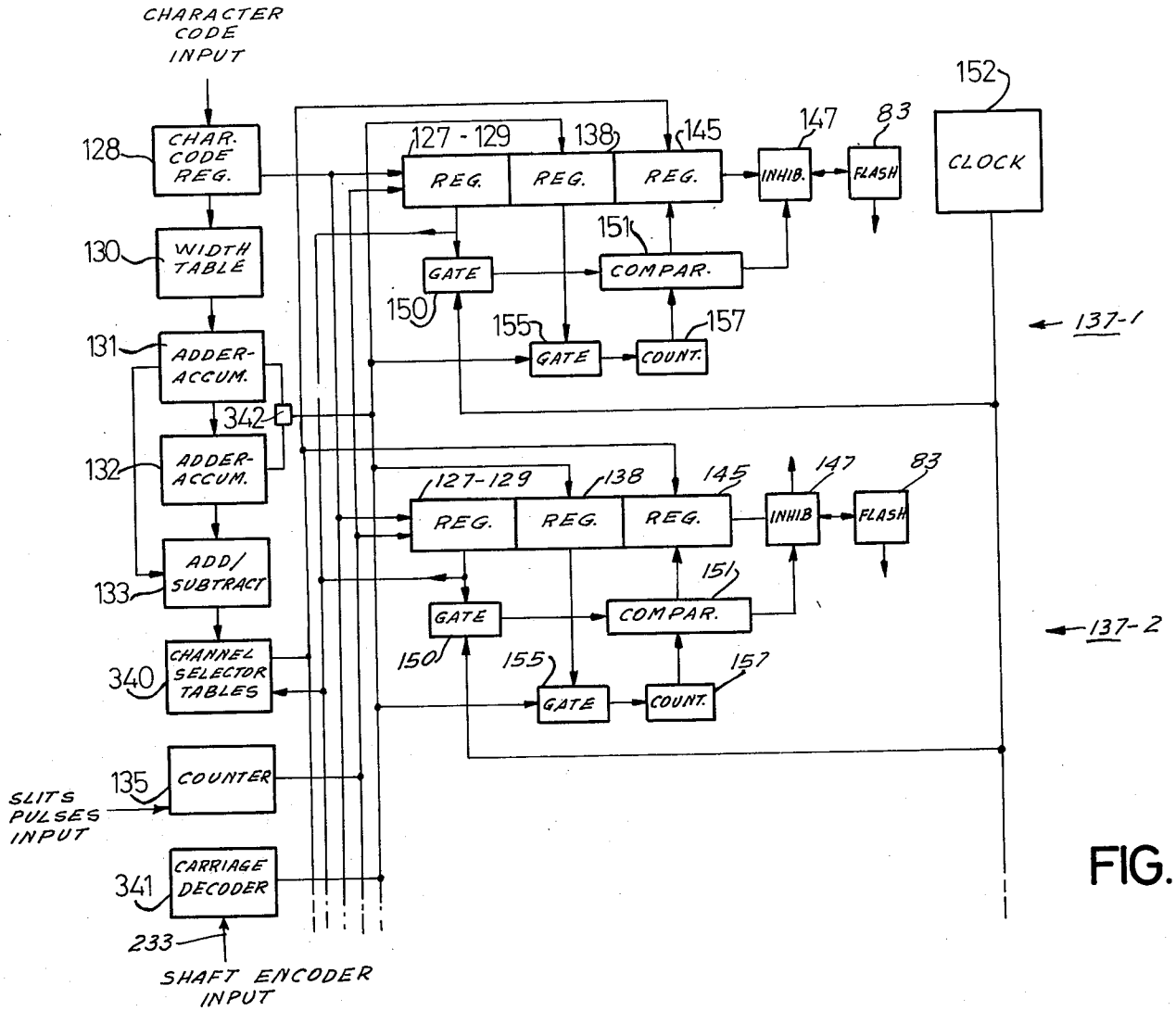

Each of FIGS. 16 to 18 represents schematically a different embodiment of the electrical control circuit of the base-line correction system of FIGS. 13 to 15;

FIG. 19 is a schematic block diagram illustrating the automatic adjustment of the base-line, magnification, light intensity and focusing for different magnifications in the machine of FIG. 1;

FIGS. 20*a* to 20*d* are illustrative diagrams showning the inaccuracies which can be automatically compensated for by means of the invention;

FIG. 21 is a schematic block diagram representing additional electrical controls for the base-line correction system of the invention;

FIGS. 22*a* to 22*f* represent schematically the formation of a line of characters in accordance with the invention;

FIG. 23 is a schematic diagram representing the exit ends of an array of light pipes used in the machine of FIG. 1;

FIG. 24 is an elevation view of an alternative embodiment of the character spacing mechanism in the machine of FIG. 1;

FIG. 25 is a cross-sectional view taken along line 25—25 of FIG. 24;

FIG. 26 represents another embodiment of the invention in which the carriage used for character spacing purposes is used for line-spacing purposes instead;

FIG. 27 is a schematic block diagram showing a carriage position error detection and correction system of the invention;

FIG. 28 is a schematic block diagram of a second version of the character spacing control circuit of the machine of the invention, for use in the continuous spacing mode of operation;

FIGS. 29*a*, 29*b*, 30 and 32 are schematic diagrams and

Figure 4:
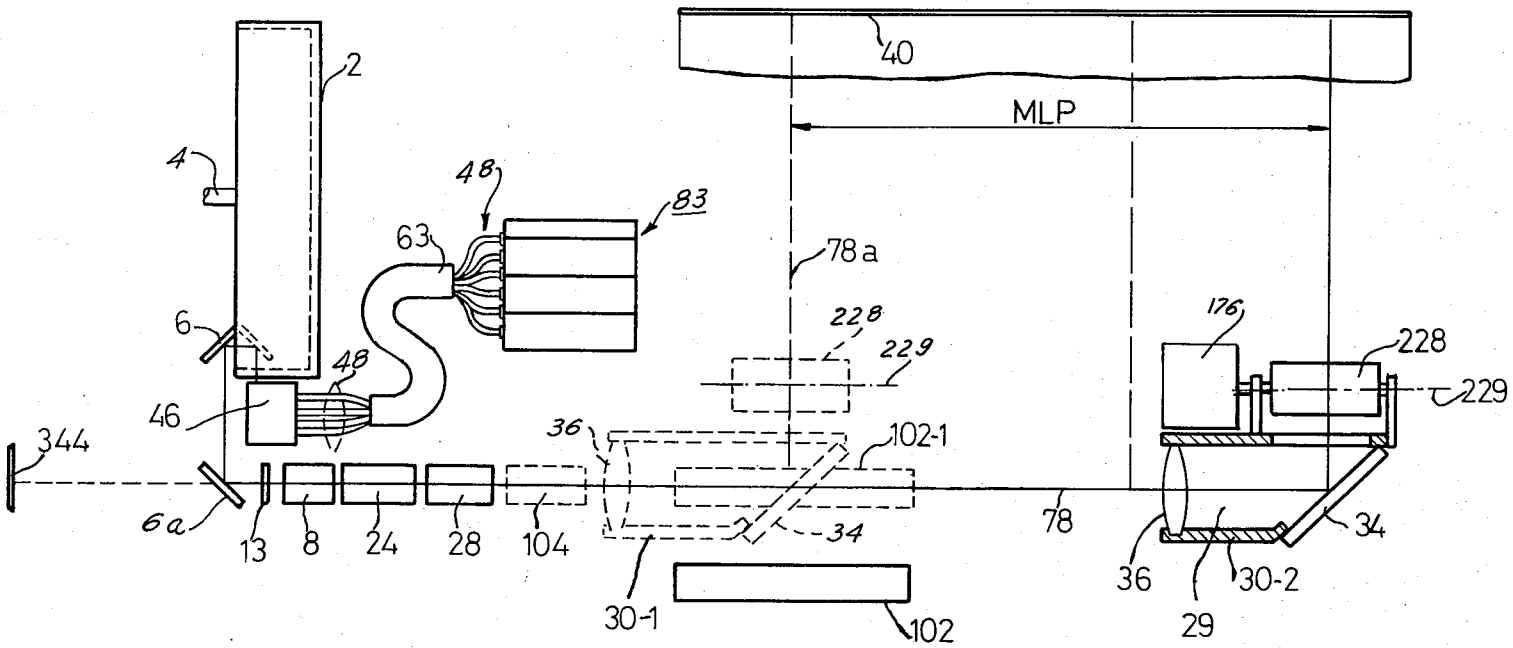
FIG. 4 is a schematic representation of an alternative embodiment of the invention.
Figure 31:
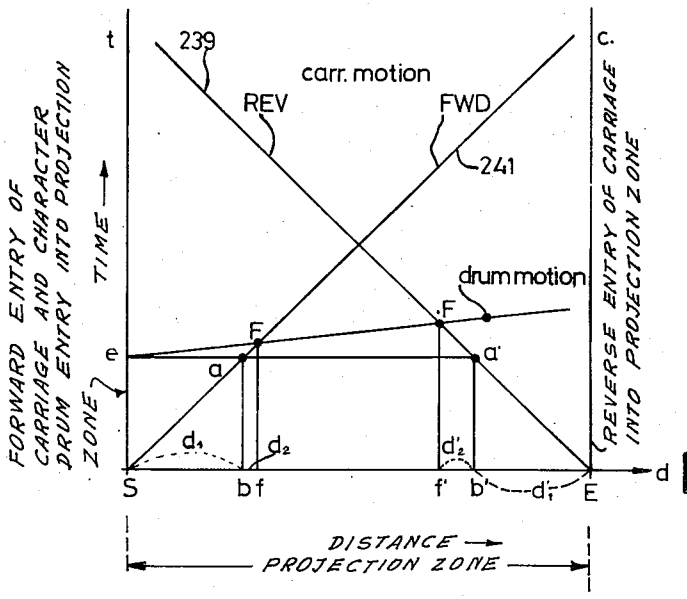
Figure 35:
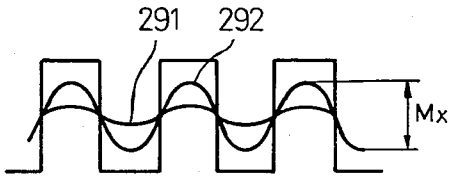
Figure 34:
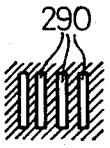
Figure 33:
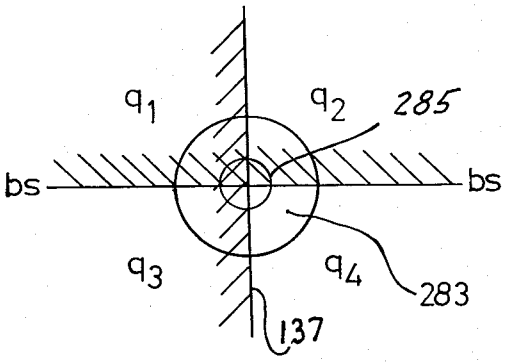
Figure 33A:
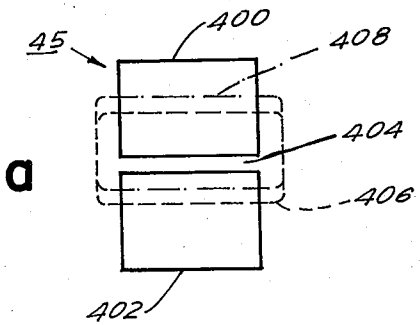
Figure 41:
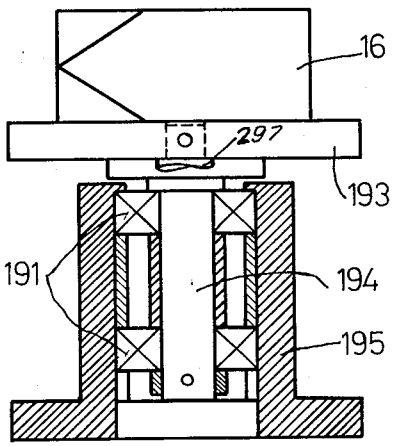
Figure 42:
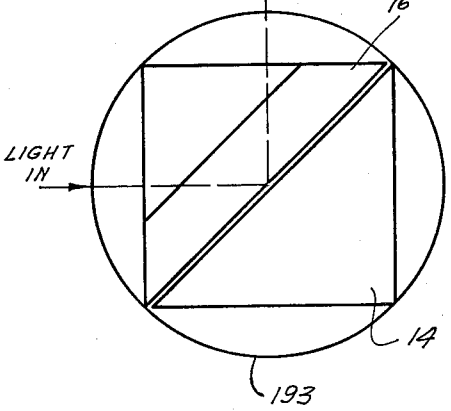
Figure 40:
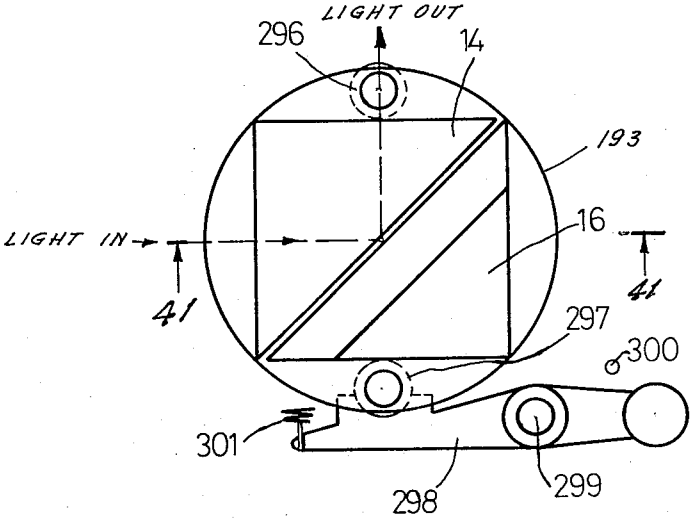
Figure 48:
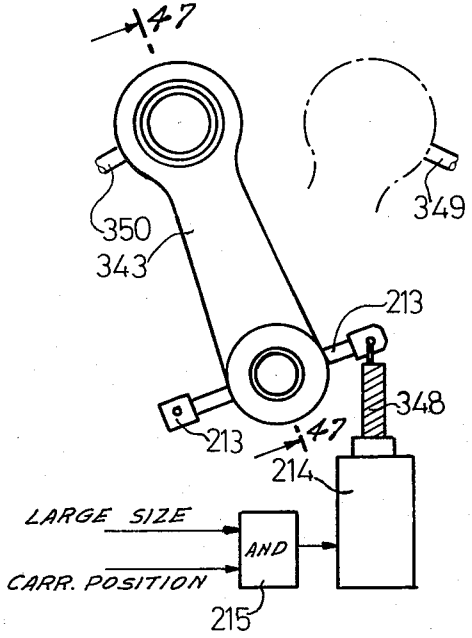
Figure 47:
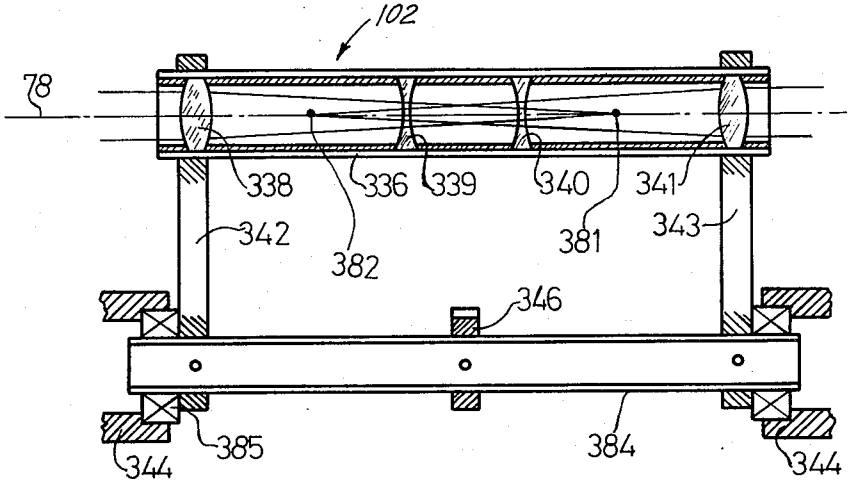
Figure 49:
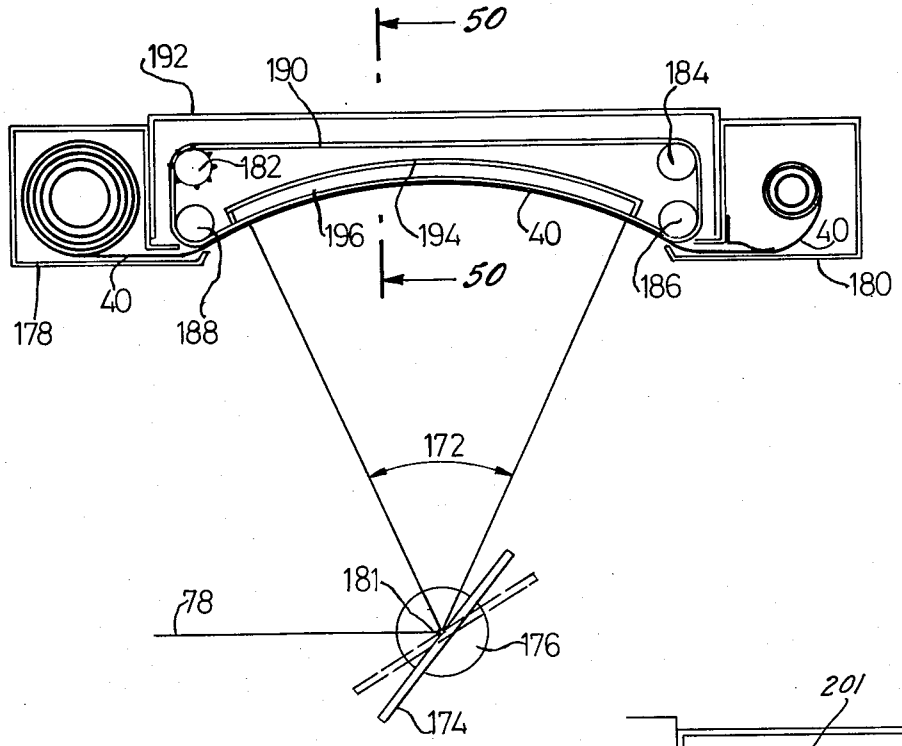
Figure 50:
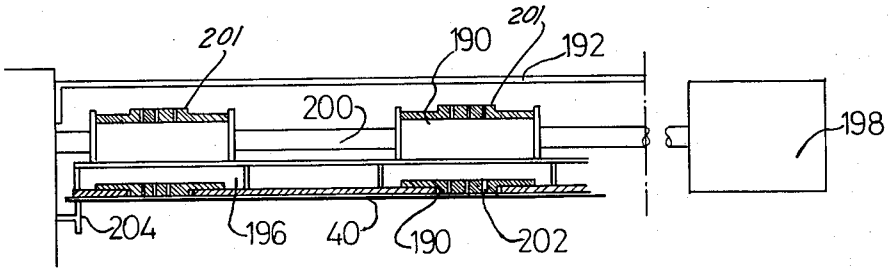
Figure 52:
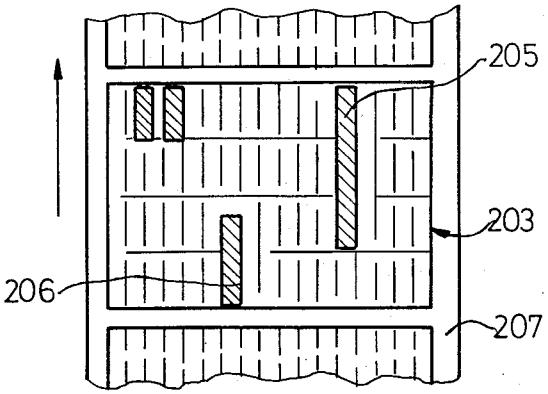
Figure 51:
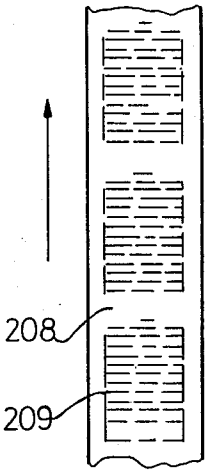
Figure 53:
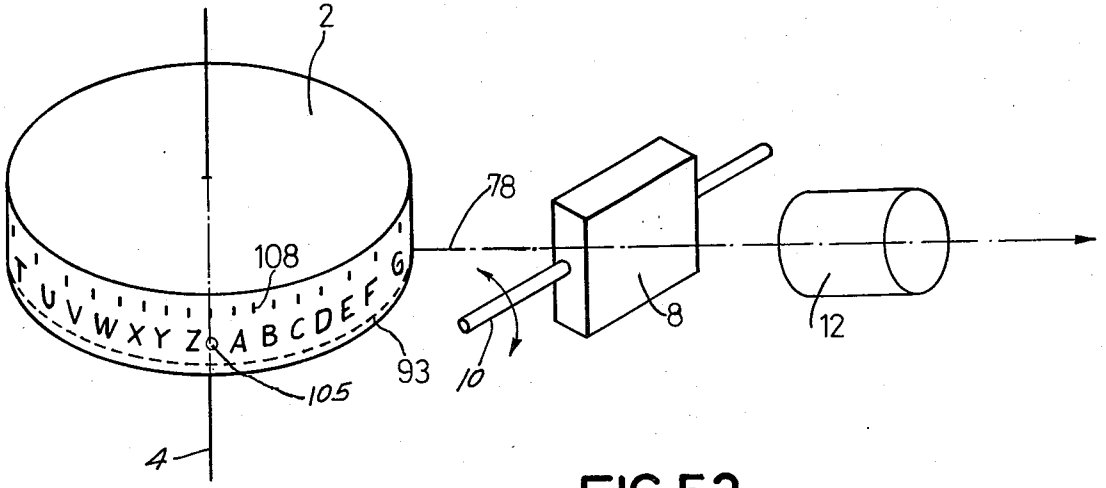
Figure 54:
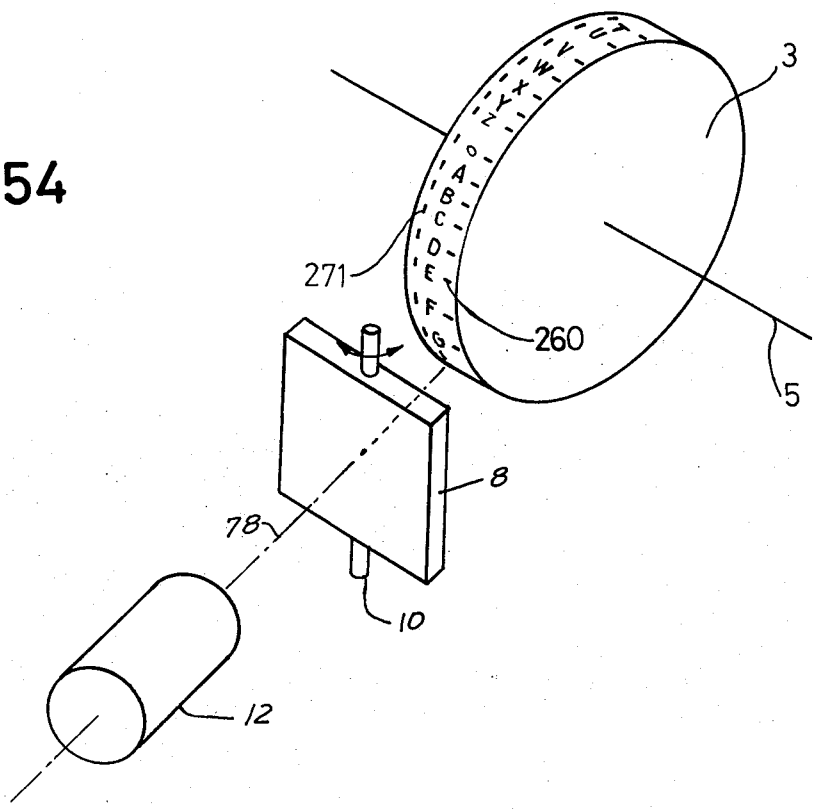
Figure 56:
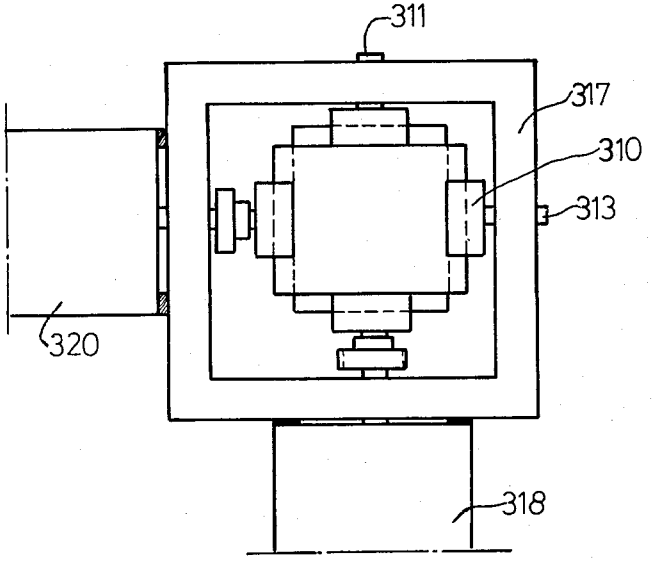
Figure 55:
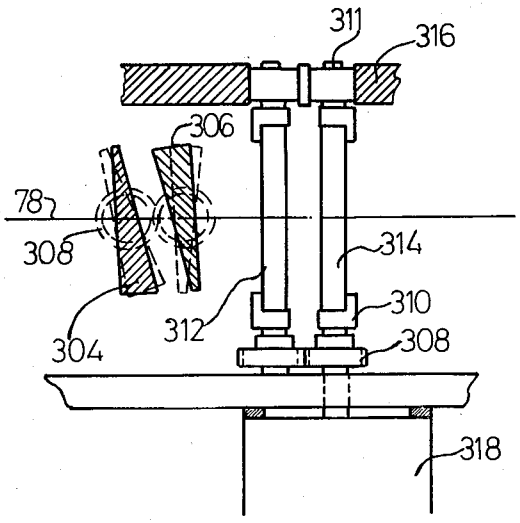
Figure 59:
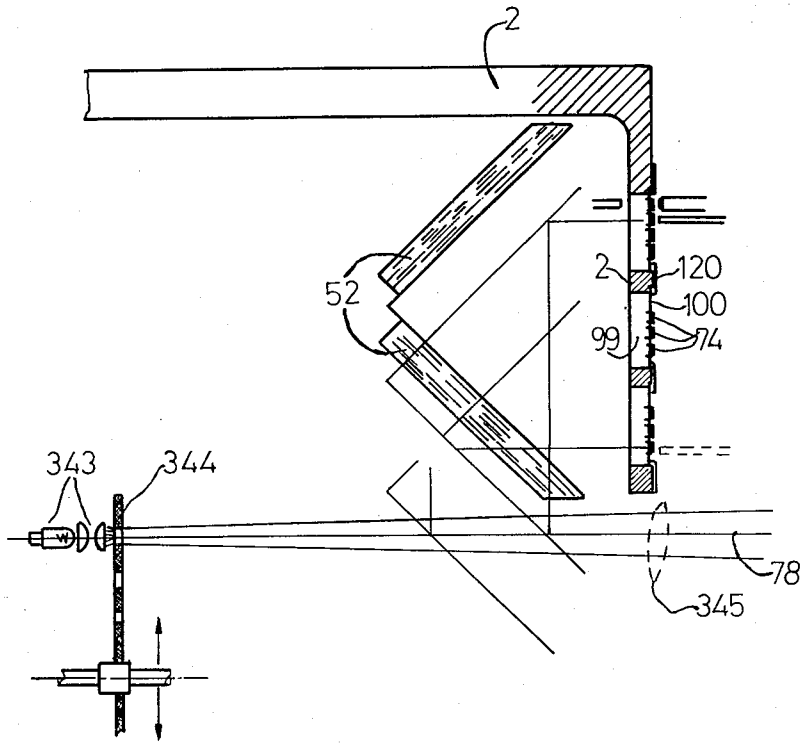
Figure 57:
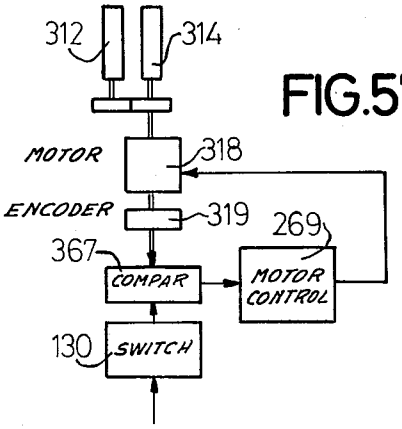
Figure 58:
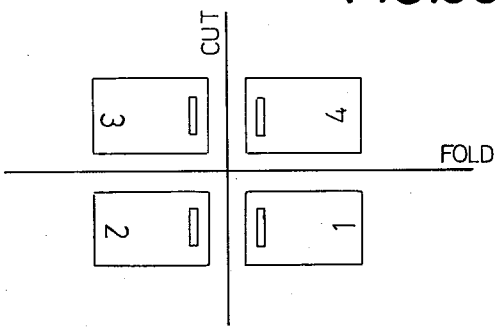
Figure 60:
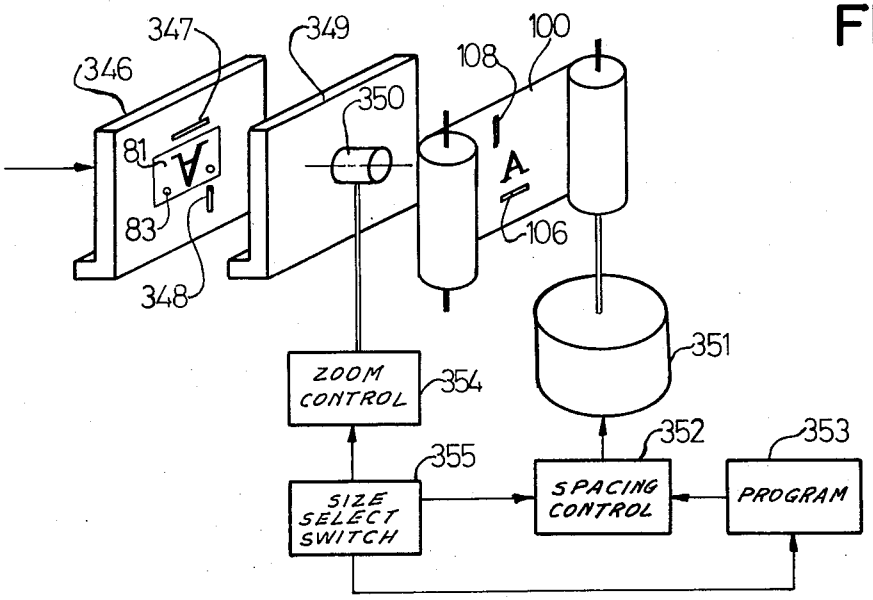
Figure 63:
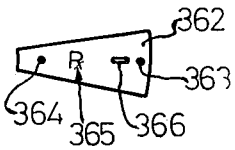
Figure 62:
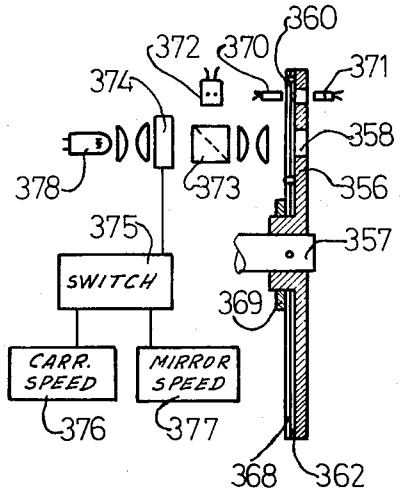
Figure 61:
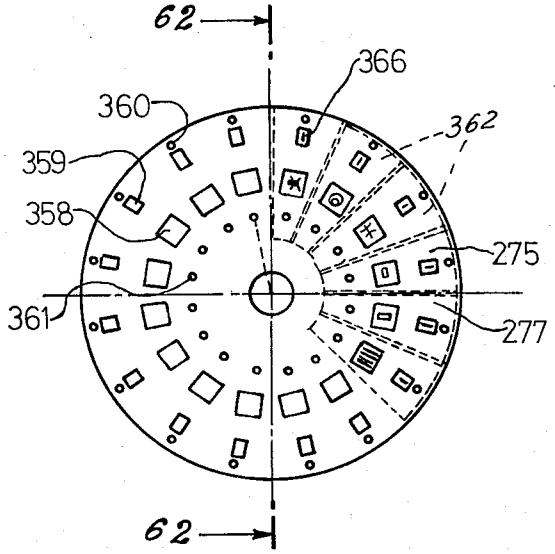

FIG. 31 is a graph, all of which illustrate the operation of the machine in the continuous mode in which characters located in a well-defined projection zone associate with an array of light channels are projected while the character spacing means is in continuous motion;

FIGS. 33 and 33*a* are schematic representations of four quadrant and two-section differential photocells used in one embodiment of the invention;

FIG. 34 shows slots used in a film strip as an aid to precise focusing of the images in the machine of the invention;

FIG. 35 is a waveform diagram showing the signals projected by useof the slots of FIG. 34 during adjustment or testing of the machine;

FIG. 36 is a schematic diagram showing means to adjust the light output of the flash lamps used in the machine of the invention;

FIG. 37 illustrates the boundaries of a typical upright character to be composed in the machine of the invention;

FIG. 38 shows the boundaries of a typical uppercase italic character;

FIG. 39 shows the boundaries of a typical lowercase italic character;

FIG. 40 is an elevation view of a multiple prism device used in the machine of FIG. 1 for changing the output of the machine between right-reading and wrong-reading copy;

FIG. 41 is a partially cross-sectional view taken along line 41—41 of FIG. 40;

FIG. 42 is a schematic view of the device of FIG. 40 with the prisms rotated by 180°;

FIG. 43 illustrates right-reading and wrong-reading text composed with the use of the device of FIGS. 40–42;

FIG. 44 shows characters which have been rotated by varying degrees by use of the mechanism shown in FIGS. 45 and 46 in the machine of FIG. 1;

FIG. 45 is a cross-sectional view, taken along line 45–45 of FIG. 46 to rotate output characters as shown in FIG. 44;

FIG. 46 is an elevation view of the device of FIG. 45;

FIG. 47 is a cross-sectional view, taken along line 47—47 of FIG. 48, which shows the afocal system of FIG. 4 which is used to de- and re-collimate light and thereby enable the machine of FIG. 1 to compose longer lines;

FIG. 48 is an elevation view of the device of FIG. 47;

FIG. 49 is a cross-sectional and schematic view of the curved film holder of the machine of FIG. 1;

FIG. 50 is a cross-sectional view taken along line 50—50 of FIG. 49;

FIG. 51 represents several pages of text composed in the mode of operation of the machine of FIG. 1 in which the carriage 30 is used for character spacing;

FIG. 52 represents a newspaper page composed by the machine of FIG. 1 in the mode of operation in which the carriage 30 is used for line spacing;

FIG. 53 is a schematic perspective view showing the use of an optical micrometer for base-line control;

FIG. 54 is another schematic perspective view illustrating the use of flash delay for base-line control;

FIG. 55 is a side elevation view of an anamorphic system using multiple optical wedges to expand or condense characters output from the machine of FIG. 1;

FIG. 56 is an elevation view of the device of FIG. 55;

FIG. 57 is a schematic circuit diagram of the control means for the device of FIGS. 55 and 56;

FIG. 58 is a schematic view illustrating the imposition of book pages on the stationary curved film used in the machine of the invention;

FIG. 59 is a cross-sectional schematic view of the auxiliary input device used for inserting Pi characters and making rules in the machines of the invention;

FIG. 60 illustrates a preferred method for the making of film strips in accordance with the invention;

FIG. 61 shows a disc bearing Pi characters and rules-forming marks for use as the auxiliary input disc of FIGS. 4 and 59;

FIG. 62 is a cross-sectional view taken along line 62—62 of FIG. 61, and a schematic view of other components of the auxiliary input system; and FIG. 63 is an elevation view of one of the removable Pi character elements used on the disc of FIG. 61.

IV. GENERAL DESCRIPTION

The general construction of the photocomposing machine is shown in FIG. 1. Opaque film strips (not shown in FIG. 1) bearing transparent master characters to be projected are located around a matrix drum 2 which is mounted on a shaft 4 for continuous rotation. A base line 106 and timing slit 108 are associated with every character. These reference marks are illuminated by lamps 44 and 42, respectively.

Figure 3:
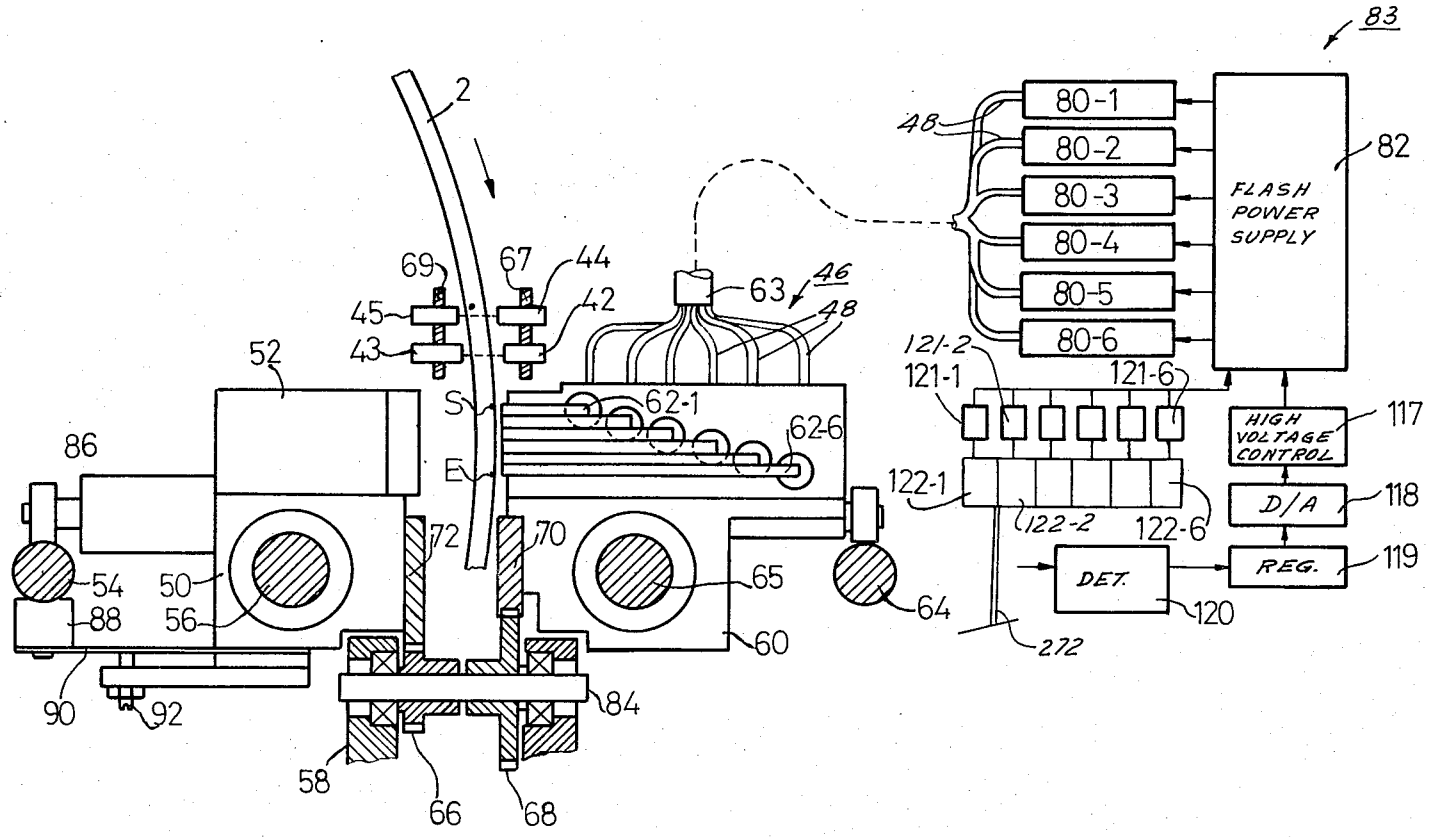
FIG. 3 is a partially cross-sectional plan view, taken along line 3—3 of FIG. 2, showing the level or style selection carriages, with a partial view of the matrix drum and associated photoelectric controls, light channels and their electronic controls, in schematic form.

Selected characters are illuminated at the appropriate time by an illumination unit 46, connected through a fiber-optic bundle 48 to a plurality of flash lamps in a flash unit 83 (FIG. 3). The light from the illumination unit 46 enters from outside of the drum 2, passes through the selected character on the film strip to form a latent image, is deflected twice by a level selection prism 6, and emerges aligned with the optical axis 78.

After leaving the level selection prism 6, the rays of light defining a character image enter a base-line correction device 8. The correction device 8 can be rotated around axis 10 to slightly deflect the light up or down in order to correct any base-line error which might occur.

The light rays emerging from the correction device 8 enter a collimating lens 12 which makes all of the rays emerging from a given point parallel to one another. The light emerging from the lens 12 enters either a right-angle prism 14 for "right-reading" copy, or a roof prism 16 for "wrong-reading" copy. Examples of right-reading and wrong-reading copy are shown in FIG. 43. The prisms 14 and 16 are mounted on a deflecting prism carriage 18 which can be moved along rails 20 to bring a selected prism in to operative position.

The light emerging from the prism 14 or 16 enters a right-angle prism 22 and is deflected ninety degrees to enter, along optical axis 78, one of a series of afocal lenses such as lens 24 mounted on a lens turret 26. A separate afocal lens 28 can be inserted in the optical path for larger magnifications. In a preferred embodiment, the afocal lens 28 multiplies by three the size of the character as determined by any lens of the lens turrent 26.

After emerging from the lens 28, the light is further deflected by ninety degrees by a mirror 34 and enters an imaging lens 36. The mirror 34 and lens 36 are mounted on a carriage 30 which can move along the path of the collimated light passing through the lenses 24 and 28 along a pair of rails 32. The bundle of light rays emerging from lens 36 is further deflected by a pivotably-mounted flat-surfaced mirror 38 which preferably is rotated in steps for spacing lines on a semi-cylindrical curved film surface 40. The mirror 38 also can be used to move a character above or below the base-line for forming superior on inferior figures, for example. When the mirror 38 is used for line spacing, the carriage 30 is moved along the rails 32 for character spacing.

In an alternative embodiment, the mirror 38 can be used for character spacing and the carriage 30 can be moved for line spacing.

The mirror 38 is mounted on an axis coincident with the axis of the semi-cylinder described by the film 40. Therefore, the mirror 38 can direct character images to any portion of the film 40 in focus and without special lenses or special optical structures, even though the film be as large as or larger than a full newspaper page. Thus, a full newspaper page can be composed without moving the film.

Character spacing is accomplished by the combination of flash timing and mechanical motion. The operation of each flash lamp is timed so that the character image projected onto the film will be at the proper location. Since the array of light-pipes in the illumination unit 46 extends over a distance encompassing several characters, the light rays defining the character images actually pass in a horizontal plane through the axis 78. Thus, by controlling the timing of the flash lamps, characters will be spaced from one another even though the character spacing carriage 30 and mirror 38 are stationary. In this respect, the character spacing is similar to that described in U.S. Pat. No. 3,643,559, the disclosure of which hereby is incorporated herein by reference.

In one embodiment of the invention, the carriage 30 moves intermittently between positions relatively widely spaced from one another, and groups or "blocks" of characters are projected onto the film while the carriage 30 is stationary. This mode of character spacing is similar to that described in U.S. Pat. No. Re 27,374 the disclosure of which hereby is incorporated by reference.

In another embodiment of the invention, the character spacing mechanism moves continuously, and the flash timing is modified to take account of the motion of the spacing mechanism.

Both of the character spacing embodiments will be described in greater detail below.

V. ROW OR LEVEL SELECTION

Figure 2:
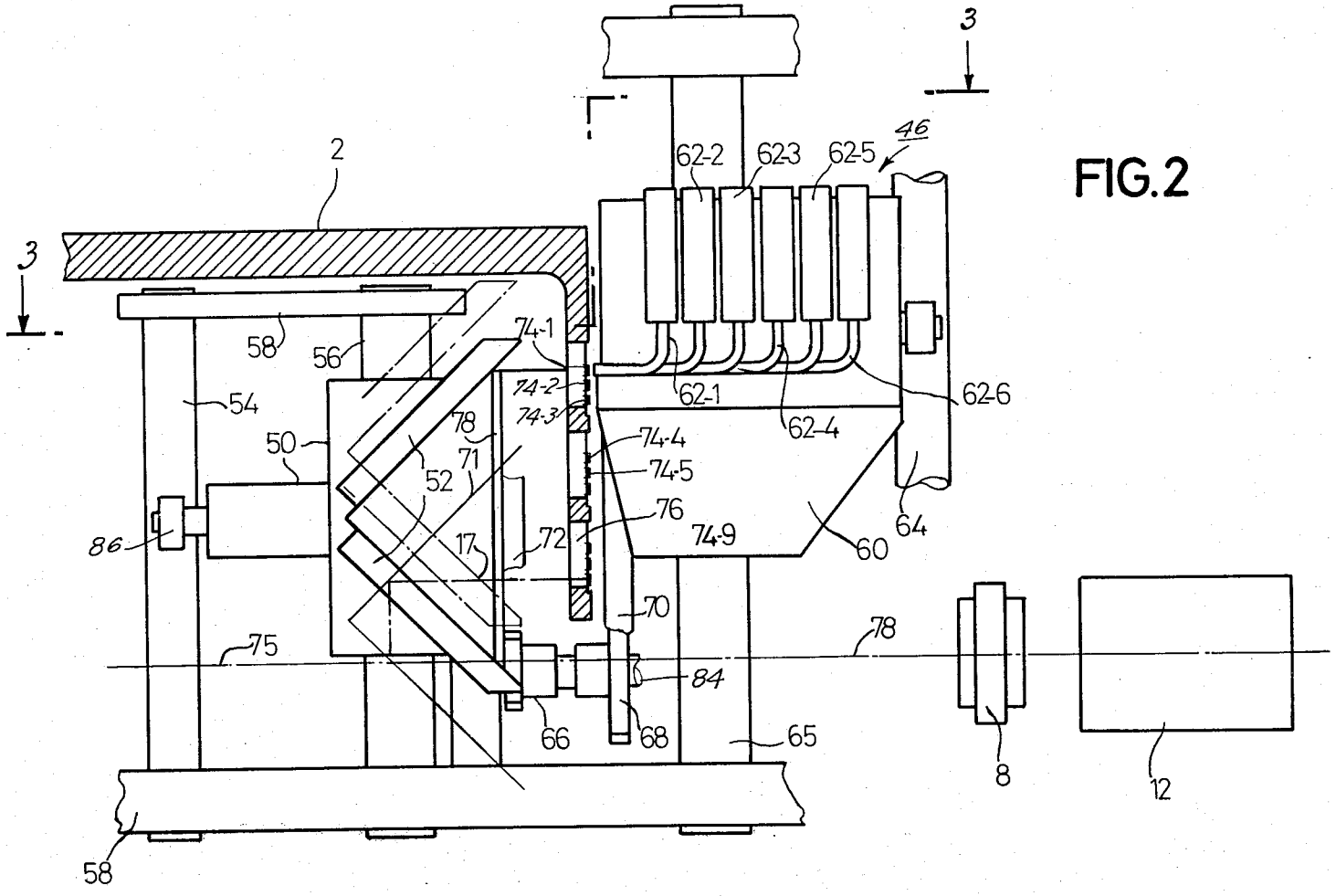
FIG. 2 is a partially cross-sectional elevation view, taken along line 2—2 of FIG. 1, showing a portion of the machine of FIG. 1 including the style or level selection carriages.

The selection of one film strip or another or one character row or another on different levels on the same film strip is accomplished by the mechanism shown in FIGS. 2 and 3. In these figures, the matrix drum is shown at 2 and nine different levels of character rows are shown at 74-1 . . . 74-6 . . . 74-9. The illumination unit 46 includes an array of light pipes 62-1 . . . 62-6, each optically connected through the fiber optic bundle 48 to individual flash lamps 80-1 . . . 80-6 (FIG. 3) controlled by a conventional flash power supply 82 in the flash unit 83. The light pipe array extends in a direction parallel to the characters in one row, and is capable of illuminating only one row of characters at a time.

The light pipes are attached to an illumination carriage 60 mounted to slide vertically along the outside surface of the matrix drum on rails 64 and 65. A rack is attached to the carriage 60 and is engaged by a pinion 68 secured to shaft 84. Another pinion 66, of a pitch diameter equal to one half of the pitch diameter of pinion 68, also is secured to the shaft 84, and engages a rack 72 which is attached to a light-deflecting carriage 50. The carriages are driven by a stepping motor (not shown).

The carriage 50 moves one-half the distance moved by the illumination carriage 60 for each revolution of the shaft 84. The light deflecting carriage 50 moves along the inside wall of the matrix drum in a direction parallel to the direction of carriage 60 along guide rods 54 and 56, mounted on fixed supports 58.

Referring to FIG. 3, a combination comprising a ball bearing 86, a friction pad 88, and a pressure blade spring 90, adjustable by the action of screw 92, insure accurate guiding of carriage 50. The carriage 50 can be provided with either a deflecting prism as shown in FIG. 1, or with two mirrors 52 mounted at right angles with respect to one another, as shown in FIG. 2.

As it is shown in FIG. 2, the light emerging from character row 74-1 is deflected by ninety degrees by the first mirror 52, and again by the second mirror 52, so that it emerges along the path 75-78. By displacing the light deflection carriage 50 by a distance equal to one half the distance separating two consecutive character rows, it is possible to align the adjacent character row with the optical axis 75–78. With the carriage in the position shown in FIG. 2, it is the uppermost character row 74-1 which is projected along line 75–78. When the carriage 50 is moved down to bring the reflecting surfaces of the mirror to positon 71, it is the bottom character row 74-9 which is projected along line 75–78. At the same time as the carriage 50 is moved, the illumination carriage 60 is also moved by the same stepping motor, so that any character row projected along line 75–78 is also "engaged" by the light pipes array of the illumination carriage. Thus, the light travel path remains the same regardless of the position of the carriages 50 and 60.

Base-line detection systems such as the one comprising an exciter lamp 44 and a differential photocell 45 is mounted at fixed locations on stationary supports such as 67; 69. Likewise, the flash timing photocell 43, energizable by lamp 42, is mounted at a fixed location. The 44–45 detector combination insures good base lines and the 42–43 detector combination insures exact flash timing, as will be explained later.

VI. AUXILIARY (PI CHARACTER) INPUT—GENERAL DESCRIPTION

A schematic view of another embodiment of the invention is shown in FIG. 4 where the same or similar components are represented by the same reference numerals as in FIGS. 1 through 3. The multiple-lamp flash unit is shown at 83. Fiber-optic bundles 48 pass through a shielding sleeve 63. The bundles 48 conduct light from the flash lamps in unit 83 to the illuminating unit 46. The light pipes (shown at 62-1 to 62-6 in FIG. 3) are cemented to the end of each fiber bundle. The purpose of using light pipes is to ensure good "mixing" of the light rays to insure uniform illumination of each character, and also to produce an accurately dimensioned and positioned light exit area for each flash lamp.

An auxiliary pi-character input unit is represented schematically at 344. Light rays defining auxiliary characters or rule-forming marks are selectively projected through a half-silvered mirror **6*a* and a filter 13 along the optical path 78. A preferred embodiment of the auxiliary input system is shown in FIGS. 59 and 61–63** and is described in detail below.

The block 104 represents a portion of the collimated area of the opitcal path 78 where various anamorphic or image-rotating prisms or other optical components are located in order to modify the size, shape or orientation of projected images.

VII. USE OF SWINGING MIRROR FOR CHARACTER SPACING

The character spacing carriage shown in solid lines at 29 in FIG. 4 differs from the carriage 30 of FIG. 1 in that the imaging lens 36 is located in front of the mirror 34. In addition, the carriage 29 of FIG. 4 carries with it a character spacing mirror 228 which is rotated around an axis 229 by a motor 176 to space character groups along the line. The lens 36 is adapted to maintain the character images in focus at the film 40 despite the changes in the length of the optical path from the mirror 34 to the film due to the distribution of character images by the flash timing system of the machine. Of course, although it is not clearly shown in FIG. 4, the film 40 is curved with its center of curvature located on axis 229. Although the film 40 is shown above the mirror 228 for the sake of clarity in FIG. 4, the film 40 actually is located behind the mirror.

The carriage 29 can be moved from the initial position 30-1 shown in dotted lines, to its extreme position 30-2 shown in solid lines for line-spacing purposes. Thus, the distance MLP which can be traveled by the carriage represents the maximum length of a page for newspaper composition, or groups of pages for book composition. The length of a page can be as long as 25 inches, for example.

VIII. COLLIMATED BEAM DIVERGENCE CORRECTION—GENERAL DESCRIPTION

In the collimated light system shown, it is well known that the maximum length of line is limited by the gradual divergence of the light bundle emerging from the collimator. The divergence is proportional to the distance from the collimator to the lens 36. The divergence also depends on the enlargement ratio of the characters, as well as the size of the characters on the matrix. In order to catch all the light rays when the carriage is at its farthest location from the collimating system to produce very long lines, it would be necessary to use an imaging lens 36 of extremely large diameter, which could lead to excessive weight, expense, and manufacturing difficulties.

This problem is resolved by the use of a special "one-to-one" afocal lens system shown at 102, which will be explained in greater detail in relation to FIGS. 47 and 48. The afocal lens system 102 is normally located as shown in solid lines so that it does not interfere with the normal travel of the light along optical path 78. For composing newspaper page columns or other composition located beyond the middle of the page, the afocal system 102 is moved to position 102-1, shown in dashed lines, in which its optical axis is accurately aligned with the optical axis 78. It should be understood that the system 102 is not located at position 102-1 at the same time that the carriage 29 is located at position 30-1, because otherwise the carriage and lens system would interfere with one another. Rather, the lens system 102 moves to position 102-1 only when carriage 29 is out of the way, and then returns to its solid-line position when carriage 29 returns.

IX. FILM STRIP

Figure 5:
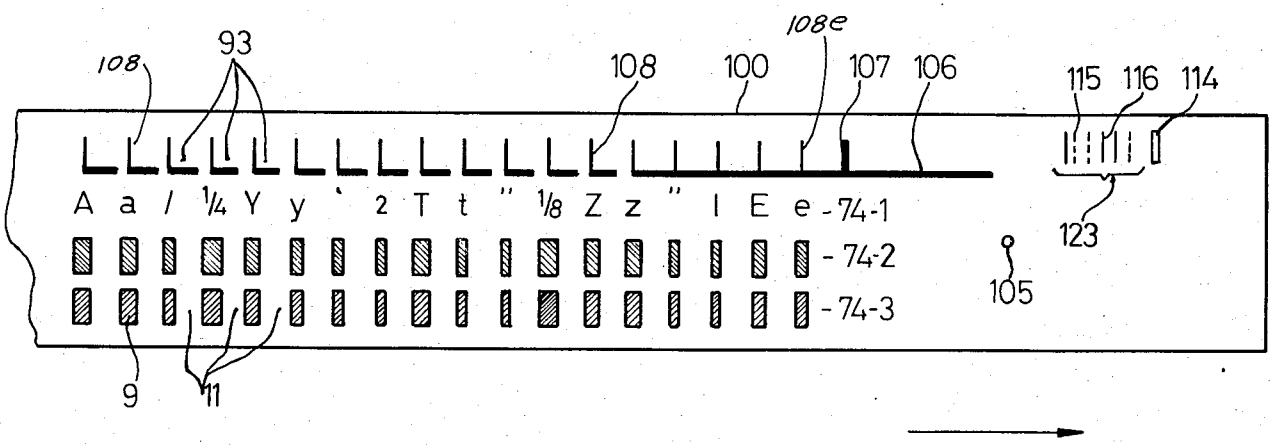
FIG. 5 represents a section of a film strip used as a character matrix in the machine of FIG. 1.

FIG. 5 shows a portion of the film strip 100 which is used in the machines of the invention. The master characters on the film strips appear as transparent areas on an opaque background. Each film strip is provided with three rows of characters 74-1, 74-2, and 74-3, the characters in each row preferably being of a different type face. In the last two rows, each character area is represented by a shaded box 9. The width of each box is determined by the character width it represents. Each of the blank spaced 11 between characters has a predetermined minimum width.

A. Base-Line Reference Marks

The film strips referably are produced by photographic means, as will be explained later in relation with FIG. 60. All the characters located in a vertical column (for example the letter "a", the box 9 and the box between these two) are photographed at the same time and simultaneously with two marks which are: the timing slit 108 of the group of characters and a base-line slit 93. Although the base-line slit is shown as a continuous line 106 at the right side of the figure, it is preferred to use unconnected segments 93 of equal length, as shown at the left side of FIG. 5.

B. Illumination Level Code Marks

The strip 100 moves continuously in the direction of the arrow in FIG. 5. The strip has a very wide slit 114 at one end. Additional coded marks or slits 123 follow the wide slit 114. These marks represent the level of illumination required for the type faces on the strip 100. If necessary, a separate code group 123 can be used to represent the illumination level of each different type face on the strip. The very wide slit 114 is the first one to be detected by the photodiode associated with the timing slits; it indicates the beginning of the strip and that the following group 123 of slits represents the illumination level.

A binary code can be used for the coded marks 123. For example, FIG. 5 shows six marks in the group 123. Thus, the code can represent any of 64 levels of illumination. A "blank" location (no slit) is shown at 115 by a dashed line, and an "active" location or slit by a solid line at 116. A small transparent dot 105 is provided for purposes to be explained below.

C. Timing Slits

A wide slit 107 is provided after the illumination level code marks. Slit 107 is narrower than very wide slit 114, but wider than the timing slits 108 and serves the purpose of signaling the beginning of the character portion of the strip. Slit 107 starts a counter which is used to select and time the flashes, as it is explained in greater detail in U.S. Pat. No. 2,775,172.

D. Film-Strip Mounting

Figure 6:
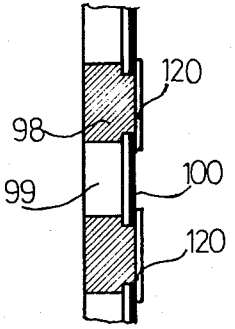
FIG. 6 is a cross-sectional view, taken along line 2—2 of FIG. 1, showing a portion of the matrix drum with three film strips in position at different levels.

FIG. 6 shows a partial cross-section of the matrix drum 2. Grooves in which film strips 100 are located are formed by solid rings, integral with the drum, shown in cross-section at 98 in the figure, and a thin ribbon-like retaining ring or band 120 attached to the drum. As the drum 2 rotates, each film strip is thrown outwardly by centrifugal force against the ring 120. Windows 99 are cut out around the drum to allow the character forming light beams to go through. Ribs such as 101 (FIG. 7) are provided to hold the drum rings 98 together. As an example, there may be six such ribs around the drum.

Figure 8:
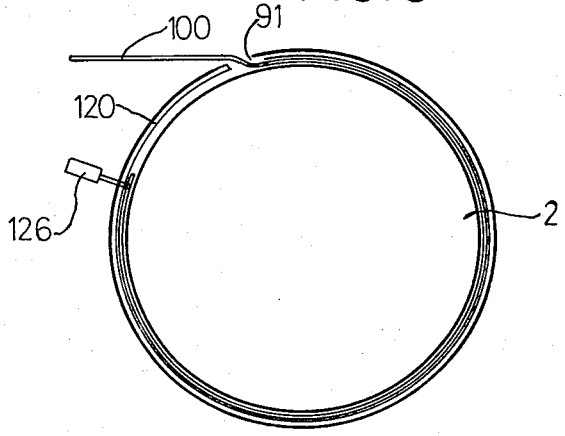
FIG. 8 is a schematic plan view of the matrix drum of the FIG. 1 machine illustrating the way matrix strips can be inserted into or removed from the matrix drum.

FIG. 8 shows a preferred means for inserting a film strip. The ring 120 has a cut-out section to provide a gap 91 through which the film strip 100 can be pushed. In addition, each film strip is provided with a small hole through which a tool 126 having a pin-like end can be engaged to pull and wrap the film strip around the drum.

X. STRUCTURE OF PROJECTION ZONE AND EXACT TIMING

As explained above, the characters are projected as they cross a relatively small projection zone located between points S and E of FIG. 3. In this figure, S represents the entry point into the projection zone when the drum rotates clockwise, as shown by the arrow, and E represents the end of the zone. An array of light pipes 62 (6 in the case of FIG. 3) is located along the well-defined projection zone, which is large enough to accommodate, for example, the projection of 15 different characters, but small enough to avoid any loss of accuracy due to the fact that after its associated timing slit is "read", the exact timing to flash a character can be adversely effected by a slight change of speed of the drum or other causes. Each light pipe is associated with a flash lamp, but is is very often necessary to flash more than one lamp to project a character. As it takes a definite recovery time, for example 800 microseconds, to flash the same lamp a second time, it is advantageous to group characters in such a sequence that it is unlikely that the same lamp must fire within such a short time interval. With this in mind the table of FIG. 9 will be described.

A. Character Sequence Selection

As it is shown in FIG. 9, the character sequence is chosen so that the most frequently used characters are separated by less frequently used characters or symbols. FIG. 9 shows 144 character positions (in the "Drum Sequence" columns). The characters include a complete set of upper case and lower case characters, and various symbols or marks (plus repeated characters) in one type face or given style. In a preferred embodiment of the invention, in each row or level there are two such sequences of 144 characters around the drum, each on a different film strip, representing two different styles. So, in the example chosen, there will be 288 character positions around the drum in each row. If the drum revolves at 20 revolutions per second, 288 characters cross the projection zone in 50 milliseconds and, if we assume that the characters were equally spaced, the time elapsed between the passage of two adjacent characters is 173 microseconds. Of course, in the actual layout the characters usually are not equally spaced, but the average spacing for a number of characters will be close to this figure. It can be seen that the most frequently used characters such as "e"; "t"; "a"; "i", etc. are 8 character spaces apart, which leaves an average of 1,384 microseconds for the recovery time of a flash lamp before it must flash another such character.

The above explains the apparently haphazard sequence of characters. Each character is identified by the numbers shown in the "drum sequence" columns. In the examples that follow, a spacing "unit" for the location of characters along the film strip has been chosen to be equal to 0.05 millimeter which is approximately one thirty sixth of five typographical points. This figure has been chosen because in a preferred embodiment of the invention the matrix film strips are provided with five-point characters. Each character area is separated from its neighbors by a minimum of 40 units or approximately 2 millimeters. That is, in FIG. 5, the space 11 between characters is at least 40 units wide. Also, a 40-unit space is left between the "start" timing mark 107 and the first character slit for the character "e". This dimension corresponds to the width of each light pipe so that any one light pipe cannot illuminate two characters simultaneously.

Referring again to FIG. 9, the maximum permissible width of each character, the width of a rather "wide" type face, is represented in the "max width" column. The column entitled "rank value" represents the actual position of each timing slit 108 from the initial mark or slit 107. These values are utilized to determine the flash timing of each character in circuits such as described in the prior art, but are not necessary in the system of present invention.

B. Selection and Operation of Light Channels—General Description

The operation of the machine to produce a line of characters will be explained with reference to FIGS. 10, 12, 23*a–b* and 22*a–f*.

Figure 12:
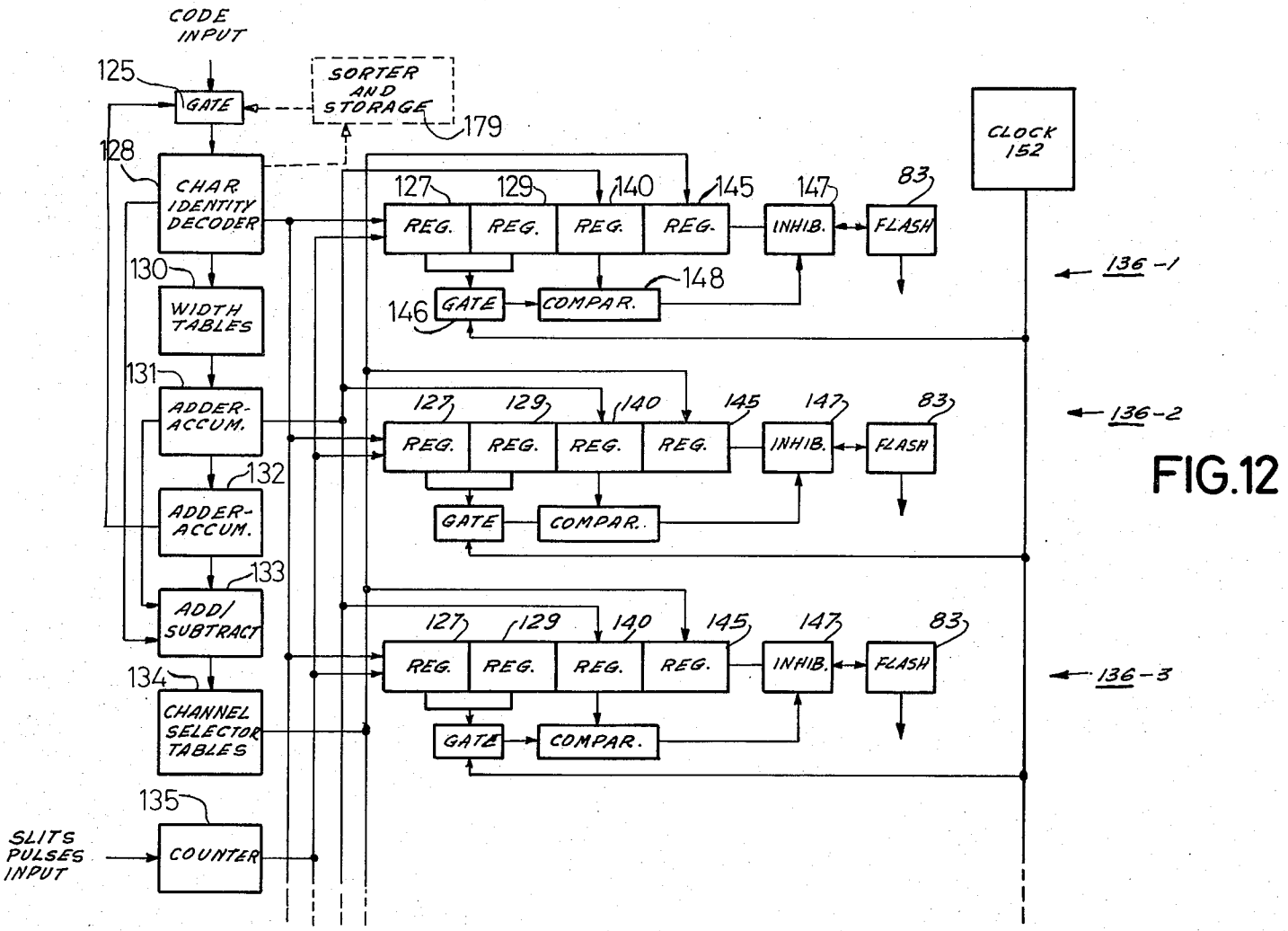
FIG. 12 is a schematic block diagram of a first version of the character spacing control circuit of the machine of the invention.

FIG. 12 is a block diagram of the character spacing control circuit. Character identity codes are delivered, from a conventional memory (not shown) which stores a full line or more of text, to a character identity decoder 128 through a gate 125. The character code is delivered to a width table circuit 130 in which the widths of the characters are stored.

The widths are transmitted from the width table circuit 130 to a first adder 131, and the to a second adder circuit 132. Adder 131 stores the total widths of the previous characters in the line, and adder 132 stores the new total including the width of the new character. It should be noted that the widths stored in the width table 130 are the actual widths of the master characters. Multiplication of those widths by a magnification factor is not necessary because "optical leverage" is used in the character projection system; that is, the characters are spaced, by means of flash-timing, before the size of the character images are determined by the optical system.

The purpose of keeping in memory both the "previous" accumulated width and the "new" accumulated width is to identify which flash lamp or lamps are to be fired. The lamp to be fired is selected by the channel selection unit 134. The units 133 and 134 will be described in greater detail below. A counter 135 receives and counts pulses from the timing slit detector.

In the preferred embodiment of the invention, a plurality of identical register circuits 136 is utilized. Only one circuit 136-1 will be described, but two others, 136-2 and 136-3, also are shown in FIG. 12. The character identity code is transferred from register 128 to the first register stage 127 and, in the case of repeated characters, the repeated character of same identity but having a different sequence code is entered into the second register stage 129. When the timing slits counter shows the same value as the value in either stage 127 or 129, a gate 146 is opened to let the clock pulses generated by a matrix drum-controlled clock 152 reach a comparison circuit 148. This comparison circuit is thus operative as soon as the timing slit of the character whose code is stored in stage 127 or 129 has crossed the starting point S of the projection zone. At this point, the work of the timing slit is ended and the flash timing of the character depends only on the number of clock pulses which will be entering into the comparison circuit 148 to reach the value, expressed in elementary spacing units located in box 140, which represents the previous accumulated width of the characters. The distance traveled by the character to be flashed between two consecutive drum-controlled clock pulses preferably is equal to the selected elementary character spacing unit. When the number of pulses entered into the comparison circuit is equal to the "previous" accumulated width, a signal is generated by the comparison circuit 148 to operate the flash circuit 83, unless it is disabled by the flash inhibit circuit 147. The identity of the light channels to be energized has been previously stored in storage unit 145, so that the flash circuit will cause only the flash lamps associated with those channels to fire.

C. Example

To illustrate the operation of the circuit the production of the following line segment will be described: "Once the innovator demonstrates during . . . ". The characters of the line are shown as they appear in the completed line in the first column of FIG. 10. The second column represents the drum sequence, the fourth column the character width and the fifth column the "preceding" accumulated width. We are assuming now that the maximum width of the projection zone is two hundred units, which means that only the characters representing an accumulated width of 200 units can be flashed without moving the character spacing carriage 30 (FIG. 1). Thus, when the accumulated width of accumulator 132 of FIG. 12 reaches 200, unit 132 develops a signal and sends it to the gate 125, and thus stops the transfer of characters from the line storage to the register 128. FIG. 10 shows that this will happen after the third character, "n", of the third word. In this example, nine registers 136 will be used to control the flashing of the ten characters because the register of the last character will store "n" as well as a duplicate "n" because there would not be enough time for flash lamp recovery, as the same lamp will be involved in the firing of both "n"s, as it will become clear later. The section 127 of the first register circuit 136-1 receives the sequence number of "0", the section 127 of the second register circuit 136-2 receives the sequence number of "n" with its duplicate, the third register circuit 136-3 receives the sequence number of the next character ("c"), etc.

If we assume now that the drum starts a new cycle, the first timing pulse representing the first character of the sequence, "e" which happens to be the fourth character in the line being composed, will cause gate 146 in the first register circuit 136-1 to open and the comparison circuit 148 will receive 66 clock pulses, representing the "preceding" accumulated width for "e", and then produce the flash signal. Then, the "e" will be spaced 66 width units from the beginning of the line, but will be the first character flashed. An important feature to point out is that the same character "e" will be flashed again at accumulated width value 134, that character being the seventh character of the line, but the same timing slit will initiate the operation of the comparison circuits 148, preferably located on two independent register circuits 136.

The importance of using the timing slit associated with a given character to flash that character anywhere within the projection zone is particularly emphasized, because of the difficulties the applicant has encountered each time he has tried to utilize another flash timing system.

D. Light Channel Selection—Detailed Description

The selection of the light channels will be described in relation with FIG. 23*a*. Six light pipe ends shown as 61-1 to 62-6 are represented in the figure. Each one is 40-units wide, and its height is sufficient to cover the tallest character or symbol. Light pipe 62-1 is operated to cover characters having a "preceding" accumulated character width of between zero and 39 units; light pipe 62-2 covers the accumulated width from 40 units to 79 units and so on, as it is indicated by the notations within each box in FIG. 23*a*. However, it is not enough to know the "preceding" accumulated width which actually represents the location of the left side of the character (or its associated timing slit), the width of the character determines also which light pipes should be fired. For this reason, as it is shown in FIG. 12, both the "preceding" and "new" accumulated widths are used to select the light channels or light pipes to be energized. The difference between the two numbers represents the width of the character to flash.

As it is shown in FIG. 10, the first character "0" of the line has a preceding accumulated width of zero. The new accumulated width appears in the same column opposite the following character. In the example it is equal to 28 units. As the first light pipe can handle 28 units alone, only the first light pipe 62-1 will be energized to project "O". The energization of the first light pipe 62-1 is indicated by an "X" in the "1" column of the "Light Pipes Activated" section of FIG. 10.

The next character of the line is "n". Its previous accumulated width is 28 but, as it is 20 units wide, the new accumulated width is 48, which is more than what the first light pipe can handle by itself. That is, the area of the "n" does not fall entirely within the area of either the first or the second light pipe, but instead spans or stradles both pipes. So, to project "n", both the first and the second light pipes 62-1 and 62-2 will be energized simultaneously.

The light channels to be activated is determined as explained above by the channels selector unit 134 shown in FIG. 12. The channel selector unit 134 preferably is a hard-wired or pre-programmed general purpose computer which receives the "preceding" and "new" character widths, and determines which channel(s) are to be used for each character, in accordance with the logical rules stated above. It then delivers to storage unit 145 of the appropriate register circuit 136 the code identifying the selected channel(s). The characters generally are not flashed in the sequence in which they appear in the line. Thus, in the example of FIG. 10, they will be flashed as follows: "e"; "e"; "t"; "i"; "n"; (repeat).

Figures 22A, 22B, 22C, 22D, 22E, 22F, 23A:
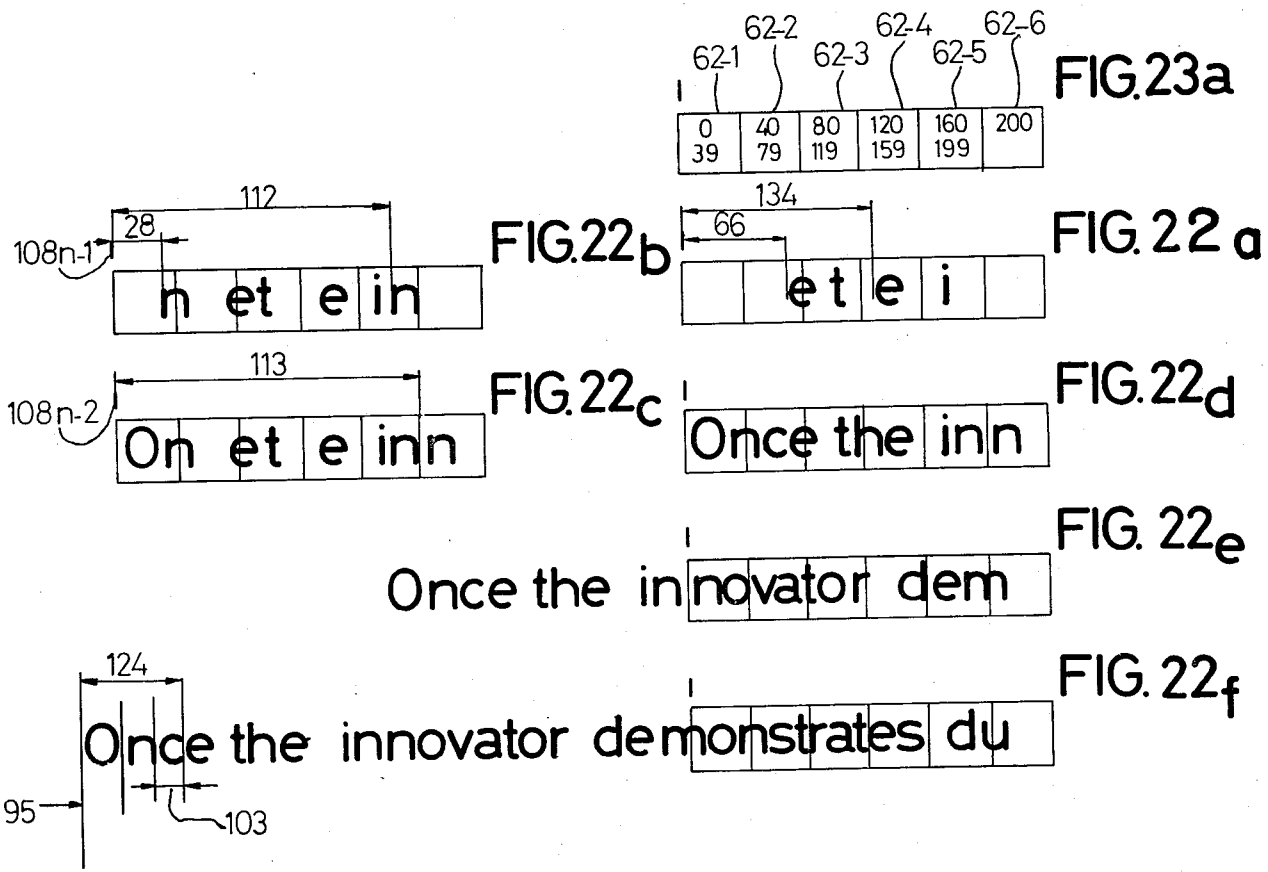

The gradual formation of the first line segment is shown in FIGS. 22*a* to 22*d*. FIG. 22*a* illustrates how the same timing slit 108*e* (FIG. 5) associated with letter "e" will produce a first "e" at 66 pulses from its entry into the projection zone, and a second "e" from the same master character at 134 pulses from its entry. At a given point in time, only the characters shown in FIG. 22*a* are projected.

A little later the line section will appear as shown in FIG. 22*b*. In this figure two identical characters "n" are again produced from the same timing slit 108*n* during the passage of the master character through the projection zone, one at 28 pulses and the other at 112 pulses, as shown. However, the following "n" being located at 113 pulses from the entry and involving the same light channel as the preceding "n", it is the repeated "n" (sequence number 64 of FIG. 9) which will be flashed.

The completed first line segment is shown in FIG. 22*d*. At this point the character spacing carriage 30 (FIG. 1) will move 200 relative units multiplied by the appropriate size factor and another segment of line will be produced by the procedure described above as illustrated in FIG. 22*e*. The character spacing carriage then will move another 200 units, and a third segment of the line will be composed as shown in FIG. 22*f*, and so on, until the entire line has been composed.

E. Italics Correction

As a rule, most commonly used characters extend between a left-hand reference line and a right-hand reference line as shown respectively, at 137 and 139, in FIG. 37. The distance "w" between these lines represents the width of the character as stored in the width tables. The intersection between the left hand reference line and the base line is represented by reference point 141 which is used as the location reference point for every character.

Italic (or slanted) characters overlap either their right or left reference lines, as it is shown in FIG. 38 and 39, by a distance shown as "r" and "l". In general, upper case characters go beyond the right hand reference line and lower case characters beyond the left hand reference line. In a matrix strip of italic characters, the same blank space of 40 units is left between the extreme ends of consecutive characters. However, as the italic characters cover an area which is wider than their actual "spacing" width, it is necessary to illuminate a correspondingly wider area. In order to simplify the electrical control circuit of the machine, the problem is solved by simply adding 8 units to the left of lower case italic characters, and 8 units to the right of upper case italic characters.

Referring now to FIG. 12, when the code for an italic character is detected, a signal is sent to the italic correction unit 133, which either subtract 8 units from the previous accumulated width in the case of lower case characters, or adds the same value for upper case characters. It must be pointed out that the new accumulated width values are used exclusively for light channel selection purposes by channel selection unit 134, and not for character spacing purposes.

Of course, the directing of different character codes to different ones of the register circuits 136, clearing of the registers after each operation, and other conventional detailed operational features are provided but are not specifically described herein because they are within the skill of the art and their description would be unduly burdensome.

In order to decrease the number of register circuits 136 used in the control circuit of FIG. 12, it is within the purview of the invention to sort the characters to be flashed during each revolution of the matrix drum in their sequence order as they appear in the "drum sequence" column of FIG. 9. Thus, as shown in dashed lines at the top of FIG. 12, a sorting circuit 179 can be used to re-arrange the sequence of characters to be flashed. These characters are stored in unit 179 after being sorted, and are fed to the register 128 and registers 136 as the latter registers become available following the flash of each character.

In this arrangement, it is not necessary to have more than 2 or 3 registers 136 because the projection of more than three different characters during the passage of the same, small, 200 unit wide, section of the drum through the projection zone will practically never occur. This fact can be determined by reference to the character sequence and spacing shown in FIG. 9. In this figure, it is shown that the average space between characters is 64 units. The total projection zone is only slightly more than three times larger. To be "short" of registers it would be necessary to select a senseless sequence of characters.

XI. CHARACTER SPACING WITH CONTINUOUS MOTION

In an alternative mode of operation of the present invention, the character spacing means such as the carriage 30 of FIGS. 1, 24 and 25 moves continuously at a substantially uniform speed during the projection of a line of characters. The operation of the machine in this mode is based on the existence of a well-defined projection zone, exactly limited to the area covered by the array of light pipes 62. The total projection zone subject to illumination is represented by the are SF of FIG. 29*a*. Actually, the 200-units zone referred to above is represented by arc SE. It is only when the timing slit of a character is within arc SE that a character can be flashed. However, as characters have a certain width extending to the right of their timing slit, an extra light pipe covering the additional arc EF has been added. So it can be said that, although the projection zone is no more than 200 units for computation purposes, the total zone that can be illuminated is larger, actually 220 units in the example of FIG. 29*a*.

Figure 29B:
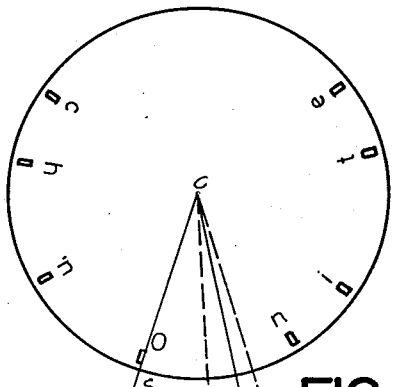
Figure 29A:
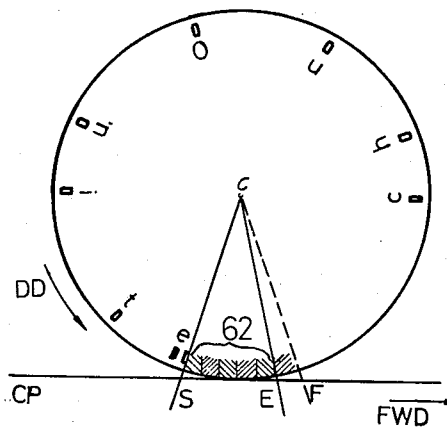

In FIG. 29*a* the carriage path is represented schematically by a line CP. It will be assumed, in the following description, that the carriage moves continuously from a point slightly ahead of a "beginning of a line" mark to another point slightly beyond an "end of a line" mark. It will be assumed also that there are 6,000 spacing units around the character drum and that the peripheral speed of the drum is thirty times the longitudinal speed of the carriage.

An important difference between the mode of operation being described and the mode of operation described above is that when a character to be flashed enters the projection zone (crossing line CS of FIG. 29*a*) the flash delay should take into account the distance traveled by the carriage from the moment the character enters the zone. In other words, the carriage should "feed back" to the electronic circuit, in a continuous way, its location from the "starting mark" of the line.

Turning now to FIGS. 24 and 25, the carriage 30 carries a pinion 222 engaging a rack 224 which is attached to the base of the machine. The pinion is attached to a shaft 231 (FIG. 25 driving an encoder 230, which, through output lead wires 233, supplies to the control circuit of FIG. 12 coded electrical signals representing the spacing carriage position.

In the embodiment of FIGS. 24 and 25, the character spacing carriage is slidably mounted on rods or rails 226 and 227. It is moved forward and backwards along these rails, generally in a continuous fashion by a drive motor 219. The motor 219 has a shaft 218 to which is attached a sprocket 217 engaging a drive belt 216 which is attached at point 235 to the carriage 30. The belt passes over an idler 220. The carriage 30 is provided with an extension 237 with a small hole 31. The hole 31 cooperates with a light beam 33 to generate a photoelectric signal at the time the carriage passes the "beginning of a line" mark. The carriage 30 is provided with a mirror 34 and a lens 36 as shown in FIG. 1, and a line-spacing mirror 38 is provided as shown in FIG. 1.

A. Control Circuit—Continuous Mode

The control circuit of the machine when operating in the "continuous mode" is illustrated in FIG. 28. The circuit of FIG. 28 differs only slightly from that of FIG. 12, and the same reference numbers represent the same components in both figures.

A full line of text can be entered, although usually it is not necessary to enter more than a few characters into register 128 in order to accumulate the widths of characters in adders 131 and 132. A plurality of register circuits 137 similar to the register circuits 136 of FIG. 12 is provided. A unit 340 is provided to determine, before a character is flashed, which light pipe (or pipes) is going to be activated. The counter 135 counts the timing slits of the drum in order to determine the time at which any character enters the projection zone.

A switching circuit 342 is provided to supply either the preceding accumulated width or the new accumulated width value to the registers 137, depending upon whether composition is in the forward or reverse direction.

The unit 341 is a decoder unit which is connected to receive signals from the carriage position encoder 230 of FIG. 25 over output leads 233. Unit 341 puts out one pulse for each unit of movement of the carriage 30, and sends it to one of a plurality of of identical register circuits 137. The pulses from unit 341 are transmitted to register stage 138 to "count down" the accumulated width value for a given character which is stored in stage 138. When the value reaches zero, it means that the carriage has reached a position along the line such that the desired character can be flashed after an appropriate delay. Thus, when the value stored in unit 138 has been exhausted, gate 155 is opened to let carriage pulses from unit 341 reach a counter 157 where they are accumulated and stored. As soon as the master character whose identity has been stored in register unit 127–129 enters the projection zone, which occurs when the count reached by counter 135 is equal to the value stored in unit 127–129, a gate 150 is opened to let the timing pulses reach a comparison circuit 151. As soon as the number of pulses thus transferred reaches the count stored in counter 157, a flash signal is generated, sent to flash inhibit unit 147 and to light channel storage unit 145 to energize the flash circuit 83.

In essence, the flash is initiated when the slit timing pulses catch up with the carrier movement pulses.

Turning now to FIG. 29*a*, it is assumed, for the sake sake of description, that the "carriage" is a film band continuously moving in the direction of arrow FWD tangentially to the projection zone of the drum. The area occupied by a character on the film band will be called a "character slot". A character slot has the width of the character it will receive, and its location on the film, from the "beginning of a line" signal is equal to the "preceding" accumulated widths of characters.

The operation of the continuous mode of the machine will be better understood by reference to FIG. 31. In this figure the Y axis represents the elapsed time and the X axis the distance traveled by the film (carriage) and the character drum. The distance between lines St and Ec represents the width of the projection zone. When the "character slot" crosses line St, as the film moves from left to right, the character that must fall in the slot is somewhere on the rotating matrix. When this character enters the projection zone by crossing line St at time "e", the character slot has moved away from line St by a certain distance. The intersection point "a" of the line originating at "e" and parallel to the X axis with line 241 representing the slot motion is at a distance $d_1$ from the projection zone entry. It can be said that from this moment on the character of the matrix drum "runs" after its "slot" in the film, until it catches it at point F.

B. Light Pipe Selection—Continuous Mode

The distance Sf actually represents the location, within the projection zone, where the character is going to be projected. This distance plus the width of the character determined which light pipes will be activated. The light pipes are determined in advance by computing distance Sf as explained below.

It is assumed, for the sake of simplicity in the explanation, that the characters are equally spaced by 50 units around the drum. The drum has, in one row or level, a full capacity of 120 characters or 6,000 units. The speed ratio between the characters of the drum and the film (carriage) is assumed to be thirty. From an examination of FIG. 31, it is evident that $Sf=d_1+d_2$. But since the speed ratio is 30, the distance eF traveled by the character after it has crossed into the projection zone is 30 times greater than the distance covered by the film during the same time interval. Thus:

$$d_1+d_2=30d_2 \quad \text{(a)}$$

and $$d_2=d_{1/29} \quad \text{(b)}$$

Now, $d_1$ is known. It is one thirtieth of the distance covered by the character drum after the character slot on the film has entered the projection zone. This is equal to $$(\mathrm{DS}\times 50-\mathrm{Ac\ W}\times 30)/30 \quad \text{(c)}$$

in which DS is the drum sequence number, as shown in FIG. 9; 50 represents the uniform spacing of characters in drum units; AcW is the accumulated width expressed in carriage spacing units, which has to be multiplied by 30 to be subtracted from the figure representing the character location on the drum, and the total is divided by 30 to represent film displacement unit. Thus:

$$Sf=(39/29)\times(50Ds-30\ AcW/30)=(50Ds=30\ AcW/29) \quad \text{(d)}$$

Sf is computed by and stored in the unit 340.

C. Example—Continuous Mode

An example will be described in relation with FIG. 11. It is assumed that the text being composed is the same as before: "Once the innovator demonstrates . . . ".

Column "D2" represents the "preceding" accumulated space of characters times 30, that is the distance the drum has to travel before the corresponding character slot on the film enters the projection zone. Column "D3" represents the value 50 Ds−30 AcW, column Sf represents the distance of the flash point from the beginning of the projection zone, and the Aw column represents the accumulated width of characters. The last column represents the light pipes or channels that will be activated for each character. These are determined by the value of column Sf, plus the width of the character as explained above and as shown in FIG. 23*a*.

Of course, as composition of the line progresses, the drum continues to rotate and the 6,000 units representing a full revolution of the drum or multiple thereof have to be subtracted as shown (see Column D2) to obtain the values in column D2 of FIG. 11.

FIGS. 29*a* shows the drum at position zero, that is when the initialization slit (the first slit on a film strip) enters the projection zone. It also shows the respective locations of the other characters used in the production of part of the line mentioned above.

FIG. 29*b* represents the position of the drum at the moment the first character "O" of the line enters the projection zone. As there is no accumulated width in this case, the "O" will reach this point after the drum has rotated by a distance equal to fifty times its sequence number, or 2,500 units. During this time, the film has moved 83.3 units and it is evident that although "O" is the first character of the line, it will not be the first one to be flashed. The first character flashed will be "n" because the "e" and the "t", which are located earlier in the drum sequence, will cross the projection zone point S before their film slots have entered the zone and they will travel a full extra revolution before being projected.

Figure 30:
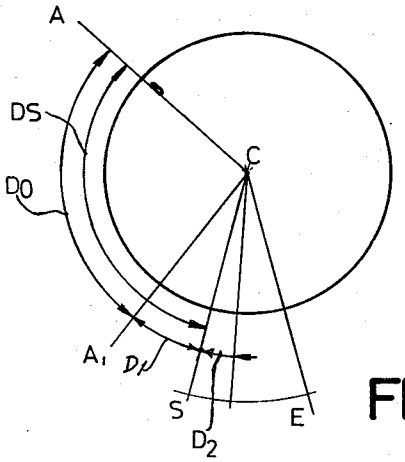

In FIG. 30, line AC represents the location of a character such as "n" when the drum initializing slit enters the projection zone, and arc DS represents the distance from that character to the initialization slit. Arc $D_0$ represents the distance traveled by the matrix character when its film slot enters the projection zone, $D_1$ represents the travel of said character after its slot has entered the projection zone, and $D_2$ the travel of the character within the projection zone before the flash occurs.

D. Composition Forward and Backwards—Continuous Mode

In the example just described, the film (carriage) was moving from left to right as shown in FIG. 29*a*, in the same direction as the periphery of the matrix drum, so that the character was actually "chasing" its slot to reach the flash location. In order to speed up the operation of the machine in the continuous mode of operation, it is desirable to produce a line when the spacing mechanism (carriage or mirror) moves backwards (against the drum rotation) as well as forward.

Figure 32:
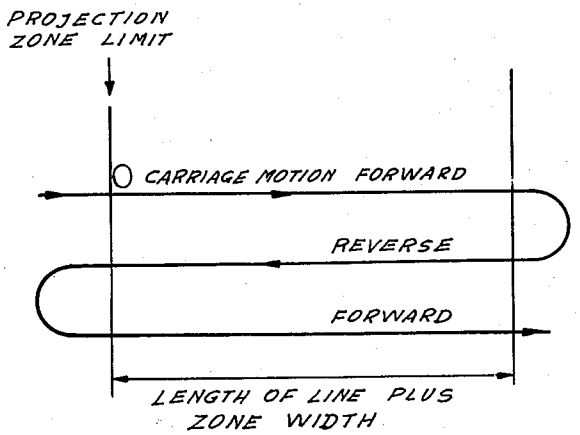

The movement of the spacing mechanism is shown schematically in FIG. 32. When the carriage returns it moves backwards from the end of the line to the beginning of the line and the characters are projected backwards, starting with those located at the end of the line. This can be achieved by buffering each line (storing the line in a temporary storage unit) and reading the buffer backwards.

In a preferred mode of operation, the accumulated width first readout is equal to the total width of the line and this total is gradually decremented for each character readout by an amount equal to its width, so that the system uses a control circuit and operates basically as in FIG. 28. However, as now the matrix character of the drum goes toward its slot (moving in the opposite direction) the value Sf' (FIG. 31) will be different from the value of SF. In addition, the width (200 units) of the projection zone has to be taken into account, since the characters will enter that zone backwards, that is from the end instead of the beginning.

The flash point of each character can be determined in a way similar to that used in the case of composition during forward motion. The difference is that $$Sf' = 200 - 31\ d_1/30, \qquad (e)$$

which means that slightly less time will elapse between ehe entry of a drum character and the moment it finds its slot. This fact is evident since, in the backwards mode, the caracter and its slot are moving in opposite directions.

XII. FILM HOLDER, PAGE AND LINE SPACING

A preferred form of the holding and drive mechanism for the film or other photosensitive sheet material is shown in FIGS. 49 and 50. Also shown is one form of the line-spacing mechanism.

The film is shown at 40. It has a relatively large area so that a full newspaper page or several pages of a book can be composed on it without moving the film. The film is fed from a supply cassette 178 to take-up cassette 180. The surface of the film is curved "the right way", that is lengthwise (as it is curled around the spools) as shown, with the center of the arc of curvature located at 181. Point 181 represents also the axis of rotation of a mirror 174 which is used for line spacing purposes, as is the mirror 38 of FIG. 1. However, a smaller mirror such as the mirror 228 of FIGS. 4 and 26 (or a multifaced mirror block) can be used for character spacing purposes in another mode of operation.

When the mirror 174 is used for line spacing, the total angle 172 covered by the movement of the mirror corresponds to the maximum depth of a page or block of copy. When the mirror is used for character spacing, the angle 172 corresponds to the maximum width of a page.

The mirror is rotated by a motor shown at 176. The motor preferably is a stepping motor, but also can be a servo-motor utilizing an analog input signal.

The film curvature can be obtained preferably by simple mechanical means, or by vacuum means. The simple mechanical means comprises retainer guide members 204 (FIG. 50) at the edges of the film 40.

The vacuum means includes a flexible belt 190 against which the film is held by the vacuum in a low-pressure air chamber formed by wa-ls 194 and 196 which are curved to form a segment of a cylinder around axis 181. Belts 190 are provided with extensions 201 having holes 202. The holes communicate the low pressure in the vacuum chamber to the back of the film to hold the film tightly to the belts. The flexible belts are driven by a stepping motor 198 (FIG. 50) through a shaft 200, on which are attached one or more sprockets 182 which engage the belt. Idlers are shown at 184, 186 and 188. In FIG. 50 two belts 190 are shown. The number of belts and their spacing depend on the maximum width of the film. The belt drive system is located in a housing 192.

XIII. MODIFIED CHARACTER PLACEMENT SYSTEM

FIG. 26 is a perspective view of the character spacing system shown in FIG. 4. The rotating mirror 228 is used to space characters along lines which are parallel to the edges of the film, as shown in FIG. 52, which shows full newspaper pages 203 formed side-by-side on the film 207.

The mirror 35 of FIG. 26 is similar to mirror 34 of FIG. 1 except that it has been rotated by ninety degrees around optical axis 78, so that the base line of projected images will also be rotated ninety degrees and will be parallel to the edge of the film 207, as shown in FIG. 52, instead of being perpendicular to the edge, as shown in FIG. 51.

The imaging lens (FIG. 26) is shown at 36, as in FIG. 1. The large "line spacing" mirror 38 of FIG. 1 is replaced by a considerably smaller (and lighter) mirror 228, as in FIGS. 4, 24 and 25. The mirror 228 is mounted on the shaft of a drive motor 176. The lens 36, mirror 35, mirror 228 and its drive motor 176, are all secured to the carriage 30, which can be similar to the one shown in FIGS. 24 and 25.

The axis of rotation 37 of the mirror 228 is located on the axis 181 of the concave cylindrical surface of the film sown in FIG. 49, where mirror 228 replaces the mirror 174. Of course, the film 40 is behind the mirror 228 so it will be in position to receive the character images. The purpose of mirror 228 is to space characters along lines, and the displacement of carriage 30 along its rails is utilized to space lines; i.e., for leading. The advantage of the system resides in that the small mirror 228 can be moved (rotated) much faster than the carriage 30 can be displaced. This is significant because only one motion is required of carriage 30 per line (or group of lines) whereas the mirror 228 has to move several times during the composition of a line, in order to space characters or groups of characters. In addition, a relatively small rotation of the mirror will cause a relatively large displacement of character images, which is important in the present system where the mirror may be called to move a distance proportional to the total width of 15 characters in one operation. On the other hand, the displacement of carriage 30 for line spacing is usually relatively small.

Of course, as described in relation with FIGS. 28, 29*a–b* and 31, the mirror can be moved in continuous fashion. In this case, what has been described as a "character slot" will be represented by the location on the film of the character projected by the mirror, the continuous rotation of which replaces the continuous motion of the carriage 30 in the previous description.

XIV. BASE LINE CORRECTION

The most basic defect of machines utilizing a film strip mounted on a drum as a matrix with the characters oriented in such a way that flash timing can be utilized for character spacing purposes is illustrated in FIG. 20*a*. This base line defect is very difficult to correct because film strips are relatively unstable and flexible. Excellent base line accuracy usually is practically impossible to achieve on a large drum because of the extreme accuracies that would be required for all the components. An important object of the invention is to correct, by automatic and electro-mechanical means, any base line variation of practical importance.

A. Correction Blade

As it is shown in FIG. 5, there is a base line mark or slit 93 associated with each character. An optical micrometer, which is a flat piece of glass with a motor to rotate it, also referred to above as a "correction blade", is used to correct base line errors, as shown in FIGS. 13 to 18.

FIG. 15 illustrates the operation of this optical micrometer. The parallel faces 23 and 24 of the galss flat 8 are normally perpendicular to the optical axis 78, but the blade can be rotated by an angle "i", to shift the base line by an amount "d". If "t" is the thickness of the glass we have, according to a well known formula $$d = t \sin (i - r)/\text{Cos } r \quad \text{(f)}$$

or, for small angles and ordinary optical glass:

$$d = t \sin i/3. \quad \text{(g)}$$

For example, a glass plate having a thickness of 5 millimeters will produce a base line correction of 0.0058 millimeter when rotated by 12 minutes of arc or 1/1,600 of a revolution. the latter figure is convenient as it corresponds to one step of widely used stepping motors.

Turning now to FIGS. 13 and 14, blade 8 is cemented to a block 154 attached to a shaft 10 which is supported by a ball bearings assembly 158 mounted in a base 156. A stepping motor to rotate the blade 8 is shown at 162.

B. Correction Blade Control

The correction blade can be controlled by various means. In a first version, shown in FIG. 18, a lamp 44 located outside the matrix drum illuminates the base line slit 93 which is located on the matrix strip 100. When no base line slit is present, no light goes through the matrix strip, but as soon as a base-line slit appears, light gradually hits the differential photocell 45 located in close proximity to the film strip.

The differential photocell 45 is well known. A suitable example is a two-element spot position sensor manufactured by United Detector Technology, Inc., 2644 30th Street, Santa Monica, California. FIG. 33*a* is an enlarged schematic drawing showing the two photosensitive elements 400 and 402 of such a sensor. The elements 400 and 402 are separated by a thin isolation zone 404 which is typically one twentieth as wide as one of the elements 400 and 402. The magnitude of the output from the sensor 45 depends on the ratio of the total amounts of light falling on each element 400 and 402. The polarity of the output depends on which element receives the most light.

The outlines of a perfectly-centered light pattern from a base-line slit 93 is shown at 406. With the light pattern in this position, the sensor output is zero. If the light pattern is higher than it ought to be, as shown at 408, an output signal of a certain magnitude will be produced. The light pattern is relatively wide and covers a substantial portion of each element 400 and 402 so as to ensure that the variation of electrical output from the photocell 45 with the distance of deviation of the light pattern from a desired base-line location will be linear.

The spot sensor shown in FIG. 33*b* is preferred for relatively small deviations of the base-line slits 93 from the desired location. If the deviations should be so large that the light from slits sometimes falls outside of the sensor, then elongated, well-known linear sensors of the same type can be used instead.

Referring again to FIG. 18, the analog output from the sensor 45 is transmitted to an analog-to-digital converter 167, whose digital output is delivered to a comparator 165 which delivers a signal to the drive motor 162 for the correction blade 8. A shaft position encoder 163 sends a digital signal corresponding to the position of the blade 8 to the comparator 165. The comparator 165 compares the output of the sensor 45 with that of the encoder 163 and delivers to the motor 162 an output signal of a magnitude corresponding to the difference between the input signals, and of a polarity tending to correct the difference. The motor then rotates the blade 8 by the proper distance to equalize the input signals. Thus, the blade 8 has been moved to correct the error in base-line location.

Figure 7:
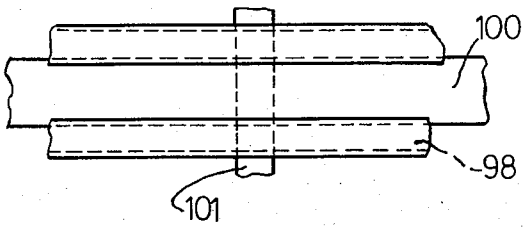
FIG. 7 is an elevation view of a portion of the matrix drum section shown in FIG. 6.

Another alternative blade control circuit is shown schematically in FIG. 7. The same sensor 45 is utilized to sense the deviation of the base line marks 93 from the ideal location and produce a corresponding error signal. However, an analog-digital converter is not needed because the position of the blade 8 is sensed by an analog system including a lamp 39 providing a slit of light similar to that emanating from the slits 93. The light from lamp 39 passes through the blade 8 to another sensor 41 like the sensor 45.

A comparator 159 compares the signals from the sensors 41 and 45 and delivers a corresponding signal to motor 162 which moves the blade 8 in the direction and by an amount sufficient to equalize the signals from the two sensors.

A third version of the base line correction circuit is shown in FIG. 16. As in FIG. 18, the exciter lamp is shown at 44, the base line slit at 93, and the film strip at 100. The mirror-roof 52 represents the level selection mirrors of FIG. 2. An image of the base line slit is made by a lens 21, and it travels through the correction blade 8 to a position sensor 27. Assuming there are only two rows of characters on the strip, there are two possible paths 77 or 79 for the light to take, depending on the position of the mirror roof. The path changes when the roof moves to a new row because there is only one base line slit per column of vertically-aligned characters.

In FIG. 16, the correction blade 8 is rotated around axis 19 by the motor 162, which is normally located on the axis 19. Two differential sensors are represented at 27, one for the upper row of characters and the other for the lower row. The control circuit 161 is a hardwire or programmed look-up table which delivers an error correction signal of the proper magnitude and polarity to the motor 162 to drive the blade 8 until it has been returned to the desired position.

FIG. 53 is a simplified perspective schematic view illustrating the operation of correction blade 8 with base-line slits 93 positioned below instead of above the characters on the matrix.

FIG. 54 shows a drum 3 on which the characters are rotated 90° from the positions shown in FIG. 53. The matrix drum 3 rotates around a horizontal shaft 5, and the base lines of the matrix characters are parallel to the shaft. In this case, the base alignment of characters is obtained by flash timing from slits 260. A base line correction can be obtained by flash delay technology, as explained in my co-pending U.S. patent application. But the use of a film strip will introduce character spacing inaccuracies. These inaccuracies can be controlled by the use of vertical correction blade 8 mounted to rotate about a vertical axis, and a control system as described above and shown in FIGS. 13–18. The blade 8 will move the character images to the right or left to correct the spacing errors.

XV. OTHER CORRECTIONS

A. Magnification Errors

Another defect in the lines produced by a machine using flash timing to space groups of characters is shown in FIG. 20*b*. If the carriage displacement does not match exactly the length of the group of characters spaced by flash timing, there will be either gaps, such as shown at 210 and 211, or overlaps at the carriage displacement points. This defect can be avoided by using high precision lenses having exactly correct magnification ratios, or by compensating mechanically or electronically for magnification errors, as will be explained in relation with FIG. 19.

1. Magnification Correction

In FIG. 19, the matrix drum is shown at 2. Point N represents the center of the projection zone between limits S and E. A Zoom lens is shown at 270. The Zoom lens is provided with a diaphragm-control ring 249, a magnification ring 250, and a focusing ring 251. Each of these rings is controlled by coded signals indicating the selected point-size. These signals are sent from sotrage 262 unit to a decoder 264. The output from the decoder 264 controls the setting of the diaphragm of the Zoom lens by use of the information stored in a diaphragm control storage unit 266. The decoder output also controls the point size setting through a coarse control unit 268, and also changes the distance moved by the character spacing carriage to correspond to the new size setting by means of a carriage control circuit 254.

FIG. 19 shows the character spacing mirror 34 and lens 36 of FIG. 1. The "home" or starting position of the mirror 34 is shown in solid lines. In this location, the mirror 34 can project an image of the dot 105 from the film strip 100 (FIG. 5) to the center of a differential photocell 282 which is mounted near and at the same distance from the lens 36 as the film plane, in order to receive properly focused images. Photocell 282 preferably is a two-element sensor of the type shown in FIG. 336.

When the dot 105 reaches the entry point S of the projection zone, a flash (or series of flashes) is generated to produce a signal from photocell 282, which is transferred by a switch 259 to a register 256 where it is stored. Then the carriage is moved by a distance equal to the width of the projection zone SE times the magnification ratio, so that the mirror 34 will move to position 34E, shown in dashed lines. Now a new flash (or series of flashes) is generated when dot 105 reaches the exit point E of said projection zone. A new signal is thus generated by the differential photocell 282 which, through switch 259 (which has been activated by the carriage motion) reaches register 257. If the light beam 253 emerging from mirror 34 at position 34E strikes the differential photocell 282 at the same point as the beam 247, registers 256 and 257 show the same value and comparison circuit 261 is ineffective. If this is not the case, the comparison circuit 261 will be able to detect, through a correction table, the amount it should cause the size control ring 250 to rotate to obtain near perfect sizing, and the correction will be made by driving the size control ring.

2. Spacing Correction

In order to eliminate the defect shown in the line of FIG. 20*b*, it is possible to modify slightly the character spacing system, rather than changing the magnification. The preferred method to achieve this goal is to use the information contained in comparator 261 to increase or decrease the clock frequency basically generated by the character drum. It is evident, from the foregoing description of the method of character spacing by flash timing, that a decrease in the frequency of the flash timing clock will spread the characters farther apart from one another, thus eliminating gaps such as shown at 210 and 211 in FIG. 20*b*, and that an increase of frequency will cause characters positioned by flash timing to be closer to each other, thus eliminating an overlap caused by insufficient magnification.

3. Adjustable Lens Correction

In the case where individual lenses mounted on a lens turret are used, rather than the Zoom lens of FIG. 19, the method described above for adjustments using a Zoom lens can be utilized if each lens has a "sizing" element which can be adjusted for exact enlargement. In this case, after moving the carriage so mirror 34 is at position 34-E, the sizing elements of the lens to be adjusted is moved into or out of the lens barrel until the output of the comparison circuit 261 is zero.

B. "Ladder" Defects

The "ladder" defect shown in exaggerated from in FIG. 20*c* can be caused by an improperly positioned reflecting or refracting surface in the system. Small defects can be taken care of by the use of a four-quadrant differential photocell of the type shown at 283 in FIG. 33 in place of the photocell 282 in FIG. 19. A four-quadrant differential photocell gives output signals which depend on the location of a projected image 285 of a reference dot. If the image of the dot is exactly centered on the baseline $b_s$ and on the left reference line 137 (FIG. 37) of each character, each of the four quadrants $q_1$, $q_2$, $q_3$ and $q_4$ receives the same amount of light. Any imbalance will give information on the misplacement of the dot. When the mirror 34 is in its home position, the image of dot 105 is centered with respect to lines $b_s$ and 137. Any deviation of the dot image from this position after the carriage has moved mirror 34 to position 34E indicates the presence, direction and value of a tilt. This information is utilized to cause the base-line correction blade 8 to gradually rotate as the flash delay increases in order to cancel out the tilt.

C. Base-Line Mis-Alignment in Abutting Film Strips

The kind of base line error shown in FIG. 20*d* can occur in the case where two independent film strips are located end-to-end on the periphery of the drum. In this case, there may be a difference of level in the base line slit located at the beginning of a strip and the one located at the end of the strip. The difference could be such that the mechanism operating the base line correction blade will not have enough time to react. To avoid this problem, any deviation "Tm" between the first and last letter of a strip is stored, so that during the passage of either the other style strip, not used at this time, or the passage of characters having no significant base line (grouped in the last quadrant of a strip as shown in FIG. 9) the correction mechanism has enough time to bring the blade back to where it should be (as stored) at the time the first character appears.

In general, if there is a problem in which the base-line deviation between abutting film strips is too great to allow the correction mechanism to operate within the time span available, the problem is solved by storing the amount of correction needed and delaying operation of the flash mechanism until the correction has been completed.

D. Base-Line Errors Due to Lens Changes

Another important feature of the automatic correction system of the machine relates to the automatic correction of base line shifts which sometimes occur due to the shift from one magnification to another magnification. These shifts are caused by mechanical inaccuracies of the Zoom lens or improperly aligned turret lenses. Here again, a differential photocell is advantageously used.

Referring to FIG. 19, when a "change size" command is received, the carriage returns to a position to start a line of composition, so that the mirror 34 is at the location shown in solid lines. A four-quadrant photocell such as 283 in FIG. 33 is used to detect the reference dot projection. When the reference dot projection is above or below the line $b_s$ of FIG. 33, the photocell generates a correction signal. FIG. 21 shows a circuit used to actuate the correction blade 8 of FIGS. 13 through 18 to perform the desired correction. The correction signal is stored in a register 169 to act upon the base line correction blade 8 operated by drive motor 162 and drive circuit 170 through an adder 168 which combines the point-size correction with the error appearing in register 166 from the base-line detector photocell 45. The value stored in unit 169 is, of course, updated each time a new point size (or magnification factor) is selected. Also updated is the zero point of the normal base-line correction circuit so that the operation of the blade described above is not affected.

E. Spacing Carriage Location Errors

Another way of improving the output quality of the machine described herein is illustrated in FIG. 27. In this figure, a position endocer device 230 produces signals representing the actual position of the spacing carriage 30. The position signals are stored in a register 240. The electrical control circuit 232 of the machine transfers to a register 234 the theoretical or desired position of the carriage at the same given time.

Any discrepancy between the values stored in registers 234 and 240 is detected by a comparator circuit 236 whose output is sent to the flash timing circuit 242 to either adfance or delay the flashes depending on the error detected.

This system corrects carriage location errors, which usually are caused by vibration or by imperfections in mechanism.

XVI. FOCUS CONTROL

Referring again to FIG. 19, in order to perfect the focusing of the optics, particularly in the case where a Zoom lens is utilized, the matrix strip can be provided with a series of closely spaced vertical slots as shown in FIG. 34. The spacing and width of the slots are within the effective resolution of the total optical system. In order to determine the best resolution, these slots are projected by the mirror 34, when they cross the center of the projection zone, through an aperture 263 to a photodiode 284 which is located at the film plane. As the master drum rotates and at the time the slots of FIG. 34 go by point N on the drum (FIG. 19), diode 284 generates a signal as shown in FIG. 35. The signal generated may have the rather flat shape of curve 291 at the beginning and, as the focus is improved, for example by use of the focusing ring 251, the curve will have a tendency to change to the shape of curve 292. As the focusing ring is turned further, the best focus point will be passed and the curve will become flatter again.

The maximum deviation Mx is recognized by a peak detector circuit. The location of focusing ring 251 when the maximum value of Mx is obtained is stored in the storage unit 274. The unit 274 returns ring 251 to that location after it has gone through the maximum. Of course a gate 265 is actuated only when a focusing test or adjustment has to be made.

Photodiode 284 can also be used to adjust the amount of light produced by the flash circuit. THis can be obtained by sending the pulse produced by photodiode 284 to the light control circuit 255 which will increase or decrease the amount of energy dissipated in the flash lamps, as needed.

XVII. LIGHT CONTROL

As mentioned in the foregoing description, the present system utilizes a multiplicity of flash lamps, six in the examples given above. These flash lamps are located in tubes 80-1 to 80-6 of FIG. 3. The flash intensity level of each lamp and the overall intensity of all lamps can be adjusted manually, preferably by potentiometers provided with the conventional flash power supply circuit 82.

In addition, as it is explained above in relation to FIG. 5, the overall intensity can be adjusted automatically by use of the illumination code marks or slits 123 which represent the level of light intensity for each type face. These slits are recognized by a photodiode detector circuit 120 which stores the binary value of the flash intensity desired in a unit 119, connected to digital-to-analog converter 118, to properly adjust the value of the high voltage power supply by means of the circuit 117.

The dot 105 of FIG. 5 can also be utilized to adjust each lamp to a uniform illuminating value. For this purpose the carriage 30 is brought back to its "home" position, so that mirror 34 is located as shown in solid lines in FIG. 19, or, more exactly, at such a position that the center of the first light pipe 62-1 of group 62 is imaged on the photocell 284 when that pipe is activated. The corresponding signal is sent to comparison circuit 122-1 through carriageoperated switching circuit 273. If the signal received by circuit 122-1 differs from a predetermined desired value, the individual flash intensity circuit 121-1 for the first flash lamp 80-1 will be corrected to correspond to the incoming photodiode-generated signal. Then the carriage 30 is moved so that mirror 34 will project the center of the second light pipe 62-2 to the center of photociode 284. The switching circuit 273 will now transfer the information to unit 122-2, in which is stored the same pre-determined value as in 122-1, so that the individual flash intensity control circuit 121-2 of light pipe 62-2 can be adjusted, and so one, until the carriage 30 has reached its final checking position where light pipe 62-6 is tested.

Of course, the system described could be simplified by replacing the automatic setting of each light intensity by manual intervention adjustment, which can be achieved by measuring and correcting, if necessary, the signal generated by photodiode 284, at each of the six "light test" carriage positions.

XVII. OPTICAL OUTPUT IMAGE CHANGES

A. Shifting Between Right-And Wrong-Reading Output Copy

The machine described herein can produce either "right" or "wrong" reading copy, as defined in FIG. 43. In the example shown, "right" reading is obtained by the use of an ordinary right-angle prism shown at 14 on FIGS. 1 and 40. Associated with prism 40 is a roof or amici prism 16, which can replace prism 40 to produce "wrong" reading copy. The two prisms can be interchanged by moving a carriage 18 as shown in FIG. 1.

In the preferred embodiment of FIGS. 40 to 42, both prisms are cemented to a plate 193 (FIG. 41) attached to a shaft 194 pivotally secured by ball bearings 191 to a housing 195, so that plate 193 can rotate around the axis of shaft 194. Referring to FIG. 40, two rollers 296 and 297 are attached to plate 193, so that they can be selectively engaged by the locking notch of a lever 298 pivoted at 299 and urged clockwise by a spring 301.

When it is desired to replace one prism by another, that is, for example, to go from right reading to wrong reading, the lever 298 is manually pivoted counterclockwise until it is stopped by pin 300, and the plate 193 is rotated 180 degrees, so that the lever 298 engages the opposite roller 296.

B. Re-Collimating and De-Collimating System

FIGS. 47 and 48 represent the operation of the auxiliary afocal lens system 102 shown in FIG. 4. This system enables the production of long lines in the manner described above. In the example shown, the afocal system is composed of two identical positive lenses 338 and 341. These lenses are symmetrically positioned inside a tube 336 and are aligned on the optical axis 78 of the machine when in use.

The first lens 338 tends to make an image at point 382, which is also the location of the focal point of a negative lens 339, so that parallel light emerges from lens 339 before entering lens 340, which has its focal point at 381 which is also the focal point of exit lens 341.

Thus, the system 102 receives parallel light beams for each character point and lets the same light beams out without having the angular spread between rays representing different character points, as would be the case if the system were not used. In other words, the effect of the afocal system is to reduce the effective travel length of the light emerging from the first part of the optical system by the length of the system 102.

Referring now to FIG. 48 as well as FIG. 47, the lens tube 336 is attached at its ends to levers 342 and 343, which are pinned to shaft 384 attached to the fixed frame 344 by ball bearings 385. A ring 346 pinned to shaft 384 is provided with extensions 213. At normal "disengaged" position, a spring (not shown) urges the lever 343 to rotate counterclockwise and maintain it against a stop 350.

For long lines and/or for large point size characters or for the production of the last columns of text in a wide page such as a newspaper or magazine, a solenoid 214 (FIG. 48) controlled by circuit 215 is energized to rotate the lever 343 clockwise through the action of pull spring 348 until lever 343 rests against an adjustable stop 349 accurately located to position the axis of the optical system of tube 336 on the optical axis 78 of the machine.

C. Rotation of Characters

It also is possible to insert in the collimated optical area of the machine a dove prism or prisms to turn letters or words around, as illustrated in FIG. 44. A double dove prism is shown at 332 and 334 in FIGS. 45 and 46. The dove prisms are mounted in a rotatable holder 328 provided with circular bearing surfaces 287 and a toothed ring 330, so that it can be rotated to any position around optical axis 78 to produce the effect shown in FIG. 44 and, in particular, to correct character tilt exemplified in an exaggerated form by the second line of FIG. 44.

FIG. 45 also shows a cylindrical lens 322 secured in holder 324 provided with a control ring 326. The cylindrical lens can be rotated by various amounts around optical axis 78 to change the appearance of type, particularly in conjunction with dove prisms 322, 334 to slant characters.

D. Squeezing and Expanding Characters

One or two pairs of optical wedges can be located in the collimated light section of the machine for the purpose of changing the appearance of type. The system is shown in FIGS. 55 to 57.

Two pairs of anamorphic wedges or prisms 304, 306 and 312, 314 are located at right angles to one another on the optical axis 78. If we assume that the image-bearing light beams located around optical axis 78 will form, on the film, a square box sitting on the base line, no change will be introduced when the wedges are in the position shown in solid lines, because each pair of wedges acts as a parallel block of glass. As is well known in the optical arts, by rotating the wedges of each pair by the same amount in different directions, the assembly behaves like an anamorphic system.

As it is shown in FIGS. 55 and 56, each wedge such as 314 is cemented to supporting members such as 310, provided with a shaft 311 to which a gear 308 is attached to engage a similar gear on the associated wedge 312, so that a clockwise rotation of a wedge will rotate counterclockwise the associated wedge. Each pair of wedges is controlled by a stepping motor 318 and 320 (FIG. 56) attached to the frame 316–317 of the unit containing the two pairs of wedges. It will be evident that characters can be "squeezed" or "expanded" by the action of each pair of wedges. The unit can also be utilized to change slightly the magnification ratio obtained by a specific lens of a turret, by acting simultaneously on the two pairs of prisms.

FIG. 57 represents a circuit for the automatic control of a pair of wedges to give a pre-determined amount of compression or expansion of characters. For example, a "compress" signal of a value represented by a binary number is sent to unit 130 from the general electronic circuit of the machine. This value is compared in comparison circuit 367 to the present location (expressed by another binary number) of the selected pair of wedges. The latter location is represented by the output of a position encoder 319. The discrepancy between the actual location of the wedges and their desired location, as recognized by comparison circuit 367 causes a stepping motor control circuit 269 to operate motor 318 by the appropriate number of steps and in the right direction until the comparison circuit finds equality between the number representing the new position and the number representing the desired position.

Of course, the anamorphic wedge unit can be replaced by a cylindrical lens anamorphic system and means to vary the relative positions of the lenses in such a system in order to vary the amount of compression, expansion or size change.

XIX. AUXILIARY (PI CHARACTER) INPUT

FIG. 4 of the drawings shows one system which can be used for making an "auxiliary" entry, that is for the introduction of characters, signs or pictures not present on the matrix strip (often called "Pi" characters). This also can be accomplished without the use of any reflectors at the drum. This is achieved by driving the reflecting roof carriage 50 of FIG. 2 up to position 17 where it does not block the optical axis. FIG. 59 shows the mirrors 52 in this position, where they are above the axis 78.

In FIG. 59, the auxiliary entry is from a disc 344, which will be described in detail in relation with FIGS. 61–63. The light rays originating from an illuminating lamp-and-condenser unit 343 are shown at 345. FIG. 59 makes it clear that there is not interference between those light rays and the light deflection roof 52.

A preferred embodiment of the auxiliary entry device is shown in FIGS. 61 to 63. This device can produce characters by the use of a flash lamp. It also can produce rules by the use of continuous illumination.

Referring to FIG. 62, a disc 356 is attached to a shaft 357 which is controlled by a stepping servo motor. The disc is provided with apertures 358, 359 and accurately located pins 360 and 361 (FIG. 61). The purpose of these pins is to position, with enough precision, individual film, glass or plastic segments as shown in FIG. 63 at 362. Each segment contains two accurately located holes 363 and 364 for engaging pins such as 360 and 361. A "Pi" character is shown at 365, and its controlling slit at 366.

When the disc 356 is used in the "Pi" character mode, it is continuously rotated and through the action of an exciter lamp 371, photodiode 370, flash lamp 372, beam splitter 373 and its associated condenser, the selected Pi character is flashed at the selected time, and the light goes through aperture 358 located on the optical axis 78 of the machine when the flash occurs.

Different pie-shaped Pi-character bearing elements are shown in FIG. 61. These segments are secured by a ring 369 (FIG. 62) and transparent cover 368 to keep the elements flat and in place. In segments 275 and 277 of FIG. 61, the Pi-character is replaced by holes of appropriate shape to produce horizontal or vertical rules on the film. In order to produce a rule, the appropriate segment is brought into position on the optical axis by operation of the motor attached to shaft 357. Then the light produced by a continuous light source 378 and the associated condenser is allowed to illuminate the selected segment aperture via beam splitter 373, by operating at the appropriate time a shutter 374. The shutter unit 374 also can be provided with light-modulating components in order to vary the amount of light allowed through the rule-forming aperture by the operation of a control circuit 376, representing the actual carriage speed, for example, for horizontal rules, or circuit 377, representing the line-spacing mirror speed for the production of vertical rules. A switch 375 is operating according to the rules desired (vertical or horizontal).

XX. PAGE COMPOSITION

Since the film is stationary during the composition of relatively wide areas of composition, it is possible, for example, for the production of magazine or newspaper pages, to pre-position titles of the same size prior to composing the rest of the text. In FIG. 52, a full newspaper page is shown at 203. Thus, the point size selecting mechanism (lens turret or Zoom lens) need be operated only once for each large size used for headings. This can be accomplished easily and rapidly since any point in the page can be reached by the simultaneous operation of the spacing carriage and mirror. Page 203 shows 4 columns which can be composed one by one without film motion.

By combining the advantages of a stationary film area of sufficient dimensions and the image rotating system shown in FIGS. 45–46, it is possible to "impose" pages to produce printed forms, as shown in FIG. 58.

XXI. MANUFACTURE OF FILM STRIPS

FIG. 60 represents a preferred set-up for the production of matrix strips. The system shown is similar to the one described in U.S. Pat. No. 2,715,862, except that the base-line control slit is automatically produced at the same time as each character and its associated timing slit, and except that the characters are spaced in proportion to their actual width. Master characters such as "A" are located on transparent sheets 81, provided with holes to engage locating pins mounted on fixed bracket 346. The bracket is provided with a fixed slot 347, representing the base line slit and another slot 348 representing the timing slit. These slots and the character are back-illuminated to be projected through lens 350 mounted on bracket 349 to the matrix strip "blank" 100. Thus, in one single operation a character is produced on the matrix strip with its associated positioning and base line slits.

The matrix strip 100 is moved by pre-determined amounts by stepping motor 351 which receives the proper commands from a program unit 353 and a spacing control circuit 352.

If desired, lens 350 can be a Zoom lens which makes it possible to change the size of the matrix strip characters. The size to be produced is entered (manually for example) into a circuit 355 which simultaneously operates the mechanical Zoom control 356 and program unit 353 to change the actual spacing of master characters which is, of course, dependent on the desired size.

The above description of the invention is intended to be illustrative and not limiting. Various changes or modifications in the embodiments described may occur to those skilled in the art and these can be made without departing from the spirit or scope of the invention.

I claim:

1. In a photocomposing machine, character presentation means for presenting character images at a projection location, said character presentation means including a character matrix bearing characters, a plurality of base-line indicator marks on said matrix, each mark being located near and in fixed relationship to one of said characters, detector means for detecting the location of each of said marks relative to a fixed reference location and producing a corresponding error signal, and correction means for correcting the position of each of said character images in accordance with its corresponding error signal to align each of said images on a common base-line.

2. A device as in claim 1 in which said correction means includes an optical flat member positioned for the transmission of said images through said flat member, and means for rotating said flat member by an amount corresponding to said error signal.

3. A device as in claim 1 or 2 including means for mounting said matrix for motion past said projection location, and means for mounting said detector means at a location in advance of said projection location so as to give a certain amount of time for the operation of said correction means prior to the time for projection of the character for which the correction is to be made.

4. A device as in claim 1 or 2 in which said matrix is a film strip, said mounting means includes a drum to which said film strip is secured, a flash lamp assembly, including a plurality of flash lamps aligned linearly in the direction of motion of said film strip, means for selectively energizing a plurality of said flash lamps during each movement of said matrix past said projection location, so as to project a plurality of character images during each such movement, the characters on said film strip being arranged in rows extending longitudinally of said film strip, with the characters aligned so that their vertical axes are perpendicular to the direction of motion of said film strip, said base-line indicator marks being slits aligned parallel to said direction.

5. A device as in claim 1, said base-line indicator marks comprising slits extending parallel to the bases of the characters on said matrix, means for moving said matrix past said projection location in a direction parallel to said bases, said detector means including a lamp positioned to shine light rays through said slits, photocell means for detecting said light rays, and for producing electrical signals corresponding to the deviation of said rays from a desired location, and drive means responsive to said signals for driving said correction means.

6. A device as in claim 5 in which said photocell means includes a differential photocell for detecting said rays.

7. A device as in claim 5 in which said correction means comprises an optical micrometer having an optical flat member, correction detector means for detecting the position of said member and producing corresponding position signals, and comparator means for comparing the signals from said correction detector means with those from said photocell means, and means for energizing said drive means in accordance with the output from said comparator means.

8. A device as in claim 5 in which there are a plurality of parallel rows of characters on said matrix, with the characters being arranged in columns, there being only one of said base-line indicator marks for each column of characters, reflector means, said reflector means being movable for bringing the images from different rows of said matrix onto a common optical path to a photographic film station, each separate position of said reflector means directing light from the slits along a different axis towards said correction means, said photocell means being located between said correction means and said film station, there being a separate photocell located on each of said axes.

9. A device as in claim 1 including a photographic film station, said indicator marks being transparent, said detector means including a lamp for shining light rays through said indicator marks, and photocell means for detecting said light rays after leaving said correction means.

10. A device as in claim 1 in which said correction means includes electrically-operated shifting means for shifting said images, data storage means for storing drive signal data for developing drive signals corresponding to said error signals, and means for delivering said drive signals to said shifting means.

11. A device as in claim 1 in which said correction means includes electrically-operated shifting means for shifting said images, means for producing a position signal corresponding to the position of said shifting means, and comparator means for comparing said position signal and said error signal and delivering a correction signal to said shifting means.

12. A device as in claim 1, including means for projecting said character images onto a recording surface, and sizing means for determining the ultimate size of said images, said correction means being located prior to said sizing means in the optical transmission path of said images.

13. A character matrix for photocomposition comprising an elongated support, a plurality of characters aligned on said support with their vertical axes substantially perpendicular to the longitudinal axis of said support, a base-line reference mark for each of said characters, each of said base-line reference marks being located adjacent to and spaced precisely from one of said characters, and being substantially parallel to said longitudinal axis of said support.

14. A matrix as in claim 13 in which said support is a film strip and including timing slits parallel to said vertical axes of said characters.

15. A matrix as in claim 13 or 14 in which said characters are arranged in a plurality of longitudinal rows and a plurality of vertical columns, there being one slit and one base-line reference mark for each column of characters.

16. A character matrix for photocomposition, said matrix comprising a support, a plurality of characters of a given type face on said support, and coded indicia on said support representing the weight of said type face.

17. A matrix as in claim 16 including characters from a plurality of different type faces, each having the same weight.

18. A matrix as in claim 16 or 17 in which said matrix is an elongated film strip, with said coded indicia at the leading end of said strip.

19. A matrix as in claim 18 in which said characters are aligned with their vertical axes perpendicular to the longitudinal axis of said strip, and base-line reference marks on said strip, each of said marks being adjacent one of said characters.

20. A method of making a character matrix for photocomposition, said method comprising forming characters photographically on a film strip in longitudinal rows with the vertical axes of the characters substantially perpendicular to the longitudinal axis of said strip, and forming simultaneously with each character a base-line reference mark located precisely with respect to said character and extending substantially parallel to said longitudinal axis.

21. A method as in claim 20 including the step of forming simultaneously with each character and base-line reference mark a timing slit located precisely relative to said characters.

22. A method as in claim 20 or 21 including the step of forming a plurality of said characters in a vertical array together with each of said base-line reference marks.

23. A photocomposing machine including character presentation means for presenting character images at a projection location, said presentation means including a movable character-bearing matrix and illumination means for illuminating said characters to form said images, support means for supporting a recording member having a photosensitive surface, character positioning means including a movable reflector for bringing images of said characters to selected locations on said surface, characterized by a reference mark on said matrix, reference mark detector means for projecting an image of said reference mark towards said reflector and detecting the reflection of said image at the start and at the end of a sequence of said characters, and correction means for correcting the positions of character images reflected by said reflector so that said reference mark image is at substantially the same location at said start and said end of said sequence of characters.

24. A device as in claim 23 in which said machine includes character enlarging means located between said character presentation means and said movable reflector means, said correction means comprising means for adjusting the enlargement ratio of said enlarging means.

25. A device as in claim 23, said character positioning means including means for timing the presentation of said character images and thereby spacing the points of projection of said character images, said correction means comprising means for adjusting said timing.

26. A device as in claim 23 in which said correction means includes means for deflecting said character images upwardly and downwardly gradually relative to a base line to correct ladder type defects in the composition produced by said machine.

27. A device as in claim 23 in which said correction means includes means for deflecting said character images upwardly and downwardly relative to a base line in order to correct base-line misalignment.

28. A device as in claim 23, 24, 25, 26 or 27 in which said detector means includes a differential photocell.

29. A photocomposing machine including character presentation means for presenting character images at a projection location, said presentation means including a movable character-bearing matrix and illumination means for illuminating said characters to form said images, support means for supporting a recording member having a photosensitive surface, character positioning means including a movable reflector for guiding images of said characters to selected locations on said surface, character enlarging means located between said character presentation means and said movable reflector means, characterized by a reference mark on said matrix, reference mark detector means for projecting an image of said reference mark towards said reflector and detecting the reflection of said image before and after a change of the enlargement ratio of said enlarging means, and correction means for correcting the positions of character images reflected by said reflector so that said reference mark image is at substantially the same location before and after said enlargement ratio change, said correction means comprising an optical micrometer for slightly deflecting said images in a direction such as to perform the required correction.

30. A device as in claim 29 in which the enlargement ratio is selected from among a plurality of predetermined values, information storage means for storing the correction values for each of said ratios, and means for recalling and utilizing each of said values in response to the selection of its corresponding enlargement ratio.

31. In a photocomposing machine comprising a character matrix bearing characters, first illumination means for illuminating said characters to form character images, projection means for projecting said character images onto a recording surface, said character matrix bearing a plurality of base-line indicia located near and spaced precisely from said characters, second illumination means for illuminating said base-line indicia, detector means for detecting illumination from said base-line indicia to determine the deviation of said indicia from a pre-determined position, and adjusting means for adjusting the position of each of said images to correct said deviation.

32. A device as in claim 31, in which said adjusting means comprises means for mechanically shifting said projection means to alter the paths of said character images after they have been projected from said character matrix.

33. A device as in claim 32 including means for delaying the operation of said first illumination means until said shifting means has completed its operation.

34. A device as in claim 31 in which said first illumination means comprises a flash-lamp, and said adjusting means includes means for deflecting said images by a pre-determined amount prior to the operation of said flash lamp.

* * * * *